US009316962B2

(12) United States Patent
Matsuzaki

(10) Patent No.: US 9,316,962 B2
(45) Date of Patent: Apr. 19, 2016

(54) IMAGE FORMATION APPARATUS AND IMAGE FORMATION METHOD FOR FORMING AN IMAGE ON A FOLDED PRINT MEDIUM

(71) Applicant: Oki Data Corporation, Tokyo (JP)

(72) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/519,623

(22) Filed: Oct. 21, 2014

(65) Prior Publication Data

US 2015/0110527 A1 Apr. 23, 2015

(30) Foreign Application Priority Data

Oct. 22, 2013 (JP) ..... 2013-219257

(51) Int. Cl.
*G03G 15/00* (2006.01)
*G03G 15/20* (2006.01)

(52) U.S. Cl.
CPC ..... *G03G 15/2014* (2013.01); *G03G 15/657* (2013.01); *G03G 15/6582* (2013.01); *G03G 2215/00877* (2013.01)

(58) Field of Classification Search
CPC ..... G03G 2215/00877; G03G 15/1605; G03G 15/6582; G03G 15/657; G03G 15/2014
See application file for complete search history.

(56) References Cited

U.S. PATENT DOCUMENTS

| | | | | |
|---|---|---|---|---|
| 2008/0124099 | A1* | 5/2008 | Koinuma | 399/40 |
| 2011/0280687 | A1* | 11/2011 | Chowdry et al. | 412/1 |
| 2011/0286779 | A1* | 11/2011 | Kwarta et al. | 399/409 |
| 2011/0287357 | A1* | 11/2011 | Kwarta et al. | 430/124.2 |
| 2011/0287917 | A1* | 11/2011 | Kwarta et al. | 493/324 |
| 2012/0207509 | A1* | 8/2012 | Dobbertin et al. | 399/103 |
| 2013/0260977 | A1* | 10/2013 | Wakatabi et al. | 493/188 |
| 2013/0342874 | A1* | 12/2013 | Muramoto et al. | 358/1.18 |
| 2014/0245699 | A1* | 9/2014 | Swartz et al. | 53/429 |

FOREIGN PATENT DOCUMENTS

JP 2012-61649 A 3/2012

* cited by examiner

*Primary Examiner* — Clayton E Laballe
*Assistant Examiner* — Ruifeng Pu
(74) *Attorney, Agent, or Firm* — Mots Law, PLLC

(57) ABSTRACT

An image formation method includes: transferring a first developer image for an image formed based on image data and a second developer image for adhesion onto a print medium; folding the print medium with the first and second developer images transferred thereto; and fixing the first and second developer images to the folded print medium.

4 Claims, 16 Drawing Sheets

IMAGE FORMATION APPARATUS AND IMAGE FORMATION METHOD FOR FORMING AN IMAGE ON A FOLDED PRINT MEDIUM

CROSS REFERENCE TO RELATED APPLICATIONS

This application claims priority based on 35 USC 119 from prior Japanese Patent Application No. 2013-219257 filed on Oct. 22, 2013, entitled "IMAGE FORMATION APPARATUS AND IMAGE FORMATION METHOD", the entire contents of which are incorporated herein by reference.

BACKGROUND OF THE INVENTION

1. Field of the Invention

This disclosure relates to an image formation apparatus such as an electrophotographic printer and, more specifically, to an image formation apparatus which performs an adhesion process and the method thereof.

2. Description of Related Art

Generally, an electrophotographic printing method, for example, includes: a charging step of uniformly charging a photoconductive insulating layer; an exposure step of exposing the charged photoconductive insulating layer and eliminate charges on the exposed portion to form a static latent image; a development step of applying a developer containing at least a colorant to the latent image for visualization thereof, that is, to forma developer image; a transfer step of transferring the obtained developer image to a transfer material such as paper; and a fixation step of fixing the developer image onto the transfer material by heating, pressurization, or another proper fixing method. The development step involves a developer support and a developer supplier configured to supply a developer to the developer support. Moreover, there is an apparatus which pastes a print which is obtained by the aforementioned printing process in advance and then conducts an adhesion thereof by folding or the like for the purpose of securing the confidentiality of the printed information (see Patent Literature 1: Japanese Patent Laid-open Publication No. 2012-61649 (page 4, FIG. 1)).

SUMMARY OF THE INVENTION

However, when the conventional apparatus is used to fold a print medium and glue the surface thereof with confidential information printed thereon for securing the confidentiality, it is necessary to separately perform printing for the print medium in advance. In other words, it is necessary to perform printing and folding by two separate steps.

A first aspect of the invention is an image formation apparatus that comprises: a first image formation section configured to form a first developer image for an image based on image data; a second image formation section configured to form a second developer image for adhesion so that the second developer image is transferred onto a region of a print medium where the first developer image is not transferred in the process of transferring the first developer image onto the print medium; a transfer section configured to transfer the first developer image and the second developer image onto the print medium; a folding section configured to fold the print medium to which the second developer image is transferred, such that the second developer image is located between two surfaces of the folded print medium facing each other; and a fixation section configured to fix the first and second developer images onto the print medium which is folded, such that the two surfaces of the folded print medium facing each other adhere to each other with the second developer image.

A second aspect of the invention is an image formation apparatus that comprises: a first image formation section configured to form a first developer image for an image based on image data; a second image formation section configured to form a second developer image for adhesion with a colorless developer; a transfer section configured to transfer the first developer image and the second developer image onto a print medium; a folding section configured to fold the print medium to which the second developer image is transferred such that the colorless second developer image is located between two faces facing each other when the print medium is folded; and a fixation section configured to fix the first and second developer images on the print medium which is folded such that the two surfaces of the folded print medium facing each other adhere to each other with the second developer image.

A third aspect of the invention is an image formation method that comprises: transferring a first developer image for an image formed based on image data and a second developer image for adhesion onto a print medium; folding the print medium with the first and second developer images transferred thereto; and fixing the first and second developer images to the folded print medium.

A fourth aspect of the invention is an image formation method that comprises: a first step of transferring a first developer image for an image formed based on image data onto a print medium; a second step performing a fixation of the print medium which is already subjected to the first step; a third step of transferring a second developer image for adhesion onto a region of the print medium where the first developer image is not transferred; a fourth step of folding the print medium already subjected to the third step; and a fifth step of performing a fixation of the print medium already subjected to the fourth step.

A fifth aspect of the invention is an image formation method that comprises: a first step of transferring a first developer image for an image onto an upper side of a print medium transported along a predetermined transport path, the first developer image being formed based on image data corresponding to the upper side; a second step of transferring a second developer image for adhesion onto a region in the upper side where the first developer image is not transferred; a third step of folding the print medium already subjected to the second step; a fourth step of performing a fixation of the print medium already subjected to the third step; a fifth step of reversing the upper side and a lower side of the print medium already subjected to the fourth step and guiding the print medium to the predetermined transport path. A set of the first to fifth steps is performed for one or more times.

A sixth aspect of the invention is an image formation method that comprises: a first step of transferring a first developer image for an image onto an upper side of a print medium transported along a predetermined transport path, the first developer image being formed based on image data corresponding to the upper side; a second step of performing a fixation of the print medium already subjected to the first step; a third step of reversing the upper side and a lower side of the print medium already subjected to the second step and guiding the print medium to the predetermined transport path; a fourth step of transferring the first developer image for the image onto the upper side of the print medium already subjected to the third step, the first developer image being formed based on image data corresponding to the upper side; a fifth step of performing a fixation of the print medium already subjected to the fourth step and then guiding the print medium to the predetermined transport path; a sixth step of transferring a second developer image for adhesion onto a region where the first developer image is not transferred in the upper side of the print medium transported in the predetermined transport path; a seventh step of folding the print medium already subjected to the sixth step; an eighth step of performing a fixation of the print medium already subjected to the seventh step; a ninth step of reversing the upper side and the lower side of the print medium already subjected to the eighth step and then guiding the print medium to the predetermined transport path. A set of the sixth to ninth steps is performed for one or more times.

According to the above aspect (s), printing on a printing medium, folding of the same, and adhesion can be performed by a series of steps.

DETAILED DESCRIPTION OF EMBODIMENTS

Figure 1:
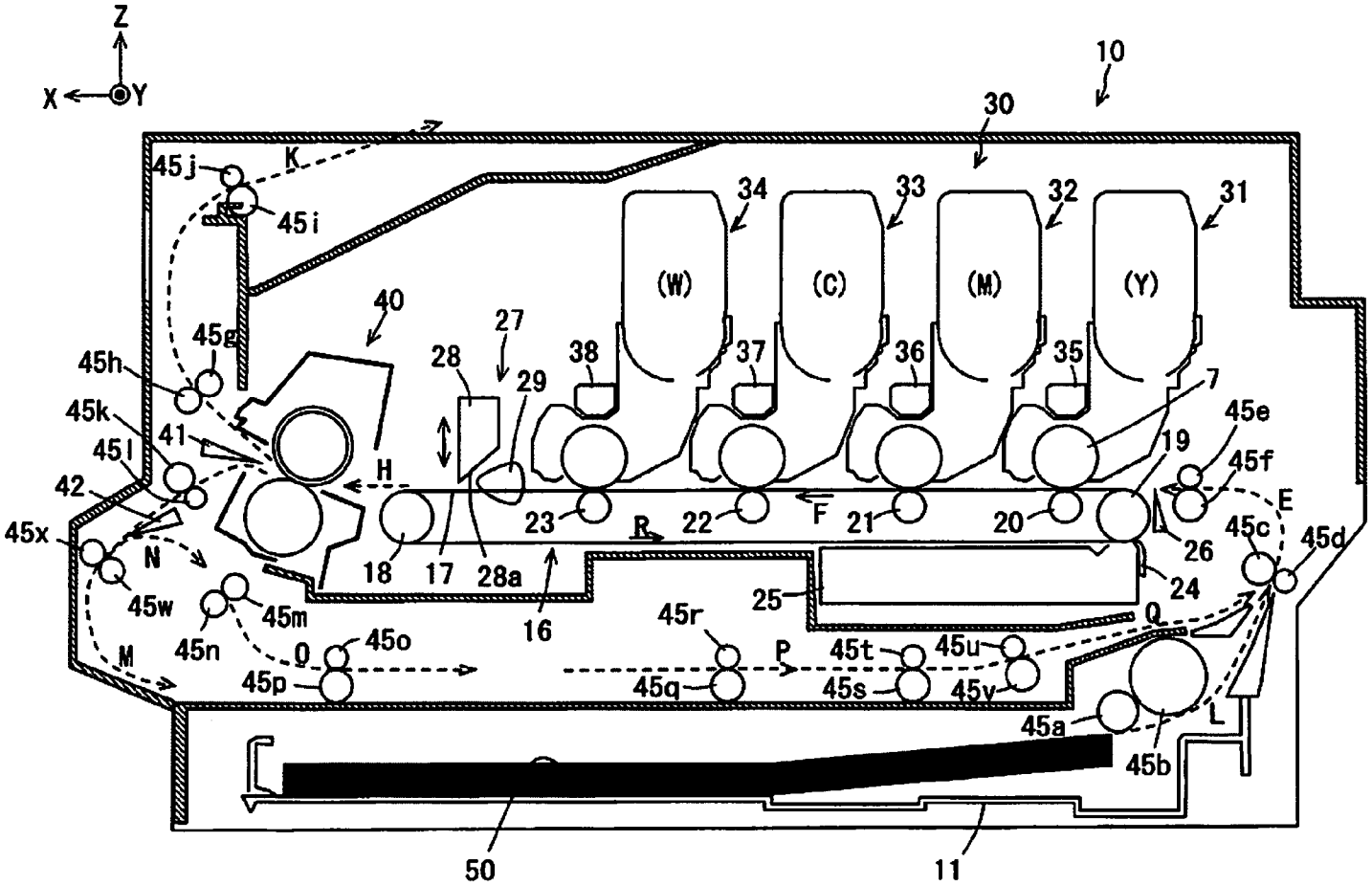
FIG. 1 is a schematic configuration diagram for explaining the configuration of a main part of an image formation apparatus according to the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

FIG. 1 is a schematic configuration diagram for explaining the configuration of a main part of an image formation apparatus according to the invention.

Image formation apparatus 10 includes a configuration as a color electrophotographic printer capable of printing four colors including yellow (Y), magenta (M), cyan (C), and white (W). As illustrated in FIG. 1, image formation apparatus 10 includes recording sheet cassette 11, image formation section 30, fixation device 40 and further includes paper transport rollers 45*a* to 45*x* configured to transport white recording sheets 50 as print media to the aforementioned portions, transport path switching guides 41 and 42, and paper folding section 27.

Recording sheet cassette 11 accommodates recording sheets 50 stacked on one another inside and is detachably attached within the lower part of image formation apparatus 10. Paper transport rollers 45*a* and 45*b* pick up recording sheets 50 accommodated in recording sheet cassette 11 from the topmost sheet one by one and feed the same along the paper transport path in the direction of dotted arrow L in FIG. 1. Paper transport rollers 45*c* and 45*d* and paper transport rollers 45*e* and 45*f* correct the skew of each sheet 50 while transporting the recording sheet 50 in the direction of dotted arrow E in FIG. 1, feeding the same to image formation section 30. Each dotted arrow in FIG. 1 also schematically illustrates the transport path of the recording sheets 50.

Image formation section 30 includes: four image formation units 31 to 34 detachably placed along the paper transport path; LED (light emitting diode) heads 35 to 38 as exposure devices; and transfer processing section 16. Transfer processing section 16 is configured to transfer developer images formed by individual image formation units 31 to 34 as described later to the upper side of recording sheet 50 with a Coulomb's force. Four image formation units, sequentially aligned starting from the upstream side of the paper transport path, that is, image formation unit 31 for yellow (Y), image formation unit 32 for magenta (M), image formation unit 33 for cyan (C), and image formation unit 34 for white (W), have the same configuration and are only different in the color of toners used as a developer, like yellow (Y), magenta (M), cyan (C), and white (W).

Transfer processing section 16 includes: transfer belt 17; drive roller 18; tension roller 19; transfer rollers 20 to 23; transfer belt cleaning blade 24; and waste developer tank 25.

Transfer belt 17 electrostatically adsorbs and transfers recording sheets 50. Drive roller 18 is rotated by a not-shown driver to drive transfer belt 17. Tension roller 19 is paired with drive roller 18 and tenses transfer belt 17. Transfer rollers 20 to 23 are arranged facing respective later-described photoreceptive drums 7 of image formation units 31 to 34 and are brought into pressure contact with the photoreceptive drums 7 with transfer belt 17 interposed therebetween. Transfer rollers 20 to 23 are subjected to such voltage that allows developer images formed on the surfaces of photoreceptive drums 7 to be transferred to each recording sheet 50. Transfer belt cleaning blade 24 scrapes and cleans toner sticking to transfer belt 17. Waste developer tank 25 accommodates the toner scraped and collected by transfer belt cleaning blade 24. Herein, transfer belt 17, drive roller 18, tension roller 19, and transfer rollers 20 to 23 correspond to a transfer section.

Paper folding section 27 corresponding to a folding section is placed between image formation section 30 and fixation device 40 as a fixation section along the paper transport path and includes rotatable cam 29 and folding member 28. Folding member 28 is movable vertically (in the Z-axis direction described later) in cooperation with the cam 29. The movement range of folding member 28 is set as follows. Folding member 28 is spaced from transfer belt 17 to allow for passage of recording sheets 50 when located at the highest position in the range of movement thereof and is in pressure contact with the transfer belt 17 so as to slightly press the same when located at the lowest position. Cam 29 is rotationally driven by a not-shown drive motor and a gear train provided for the body of image formation apparatus 10.

As for axes X, Y, and Z in FIG. 1, axis X extends in the transport direction that recording sheets 50 pass through image formation units 31 to 34, axis Y extends in the direction of the rotary axes of transfer rollers 20 to 23, and axis Z extends in the direction orthogonal to axes X and Y. Each of axes X, Y, and Z illustrated in other drawings described later indicates the same direction. Specifically, axes X, Y, and Z in the drawings indicate directions when each drawn portion in the drawings constitutes image formation apparatus 10 illustrated in FIG. 1. Herein, each portion is located so that axis Z extends in a substantially vertical direction.

Herein, a description is given of the configuration of image formation unit 34 including white (W) toner. Image formation unit 31 including yellow (Y) toner, image formation unit 32 including magenta (M) toner, and image formation unit 33 including cyan (C) toner have the same configuration as that of image formation unit 34 including white (W) toner excepting only the toner color, and the description thereof is omitted.

Figure 2:
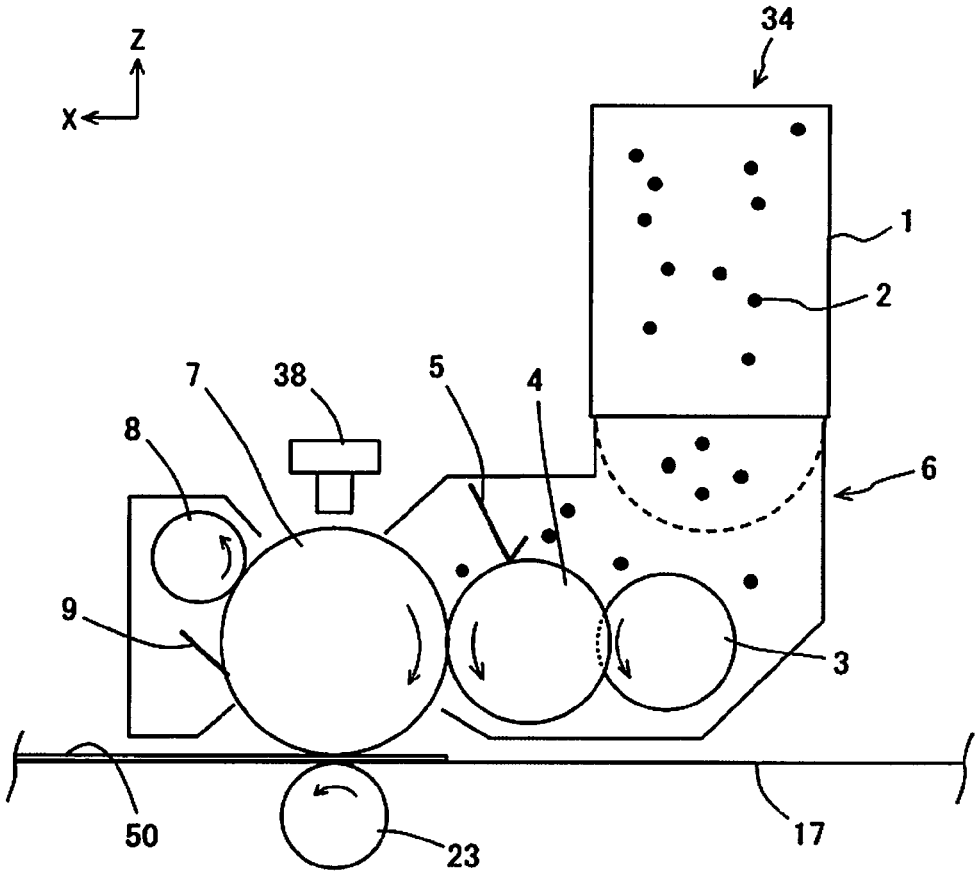
FIG. 2 is a schematic configuration diagram schematically illustrating an image formation unit for white (W) together with a transfer belt, a transfer roller, a recording sheet of paper, and an LED head for white (W).

FIG. 2 is a schematic configuration diagram illustrating image formation unit 34 for white (W) together with transfer belt 17, transfer roller 23, recording sheet 50, and LED head 38 for white (W).

As illustrated in FIG. 2, image formation unit 34 includes photoreceptive drum 7 rotatable in the direction of the arrow. Around photoreceptive drum 7, charge roller 8 and LED head 38 are provided sequentially from the upstream side in the rotation direction of photoreceptive drum 7. Charge roller 8 comes into contact with the surface of photoreceptive drum 7 with a constant pressure and supplies charges for charging photoreceptive drum 7. LED head 38 irradiates (exposes) the surface of the charged photoreceptive drum 7 with light to form an electrostatic image.

Image formation unit 34 further includes development section 6 and cleaning blade 9. Development section 6 causes toner 2 of a predetermined color (white, herein) to stick to the surface of photoreceptive drum 7 with an electrostatic latent image formed thereon for development. Cleaning blade 9 removes transfer residual toner remaining after the developer image on the photoreceptive drum 7 is transferred to the recording sheet 50. Cleaning blade 9 is therefore made of an elastic material and is placed so that the edge thereof is in contact with the surface of the photoreceptive drum 7 with a certain pressure.

Development section 6 includes: toner cartridge 1 accommodating and supplying toner 2 (white, herein); development roller 4; sponge roller 3 supplying toner 2 supplied from toner cartridge 1 to development roller 4; and development blade 5 forming toner 2 on development roller 4 into a thinner layer. Development section 6 visualizes the electrostatic latent images formed on the surface of the photoreceptive drum 7, that is, develops the same. Image formation unit 34 is configured so that toner cartridge 1 is detachably provided above sponge roller 3.

Development roller 4 and sponge roller 3 are placed in parallel to each other so as to come into contact at a certain pressure and rotate in respective directions of the arrows illustrated in FIG. 2 (in the same direction). As illustrated in FIG. 2, development blade 5 and development roller 4 are placed parallel to each other so that the bent portion of development blade 5 is in contact with the circumferential surface of development roller 4 at a certain pressure, for example.

Herein, a description is given of a specific example of each part.

Development roller 4 includes: a core made of copper with the surface nickel-plated; an elastic layer formed around the metal core and made of urethane rubber; and a surface layer of isocyanate formed on the surface of the elastic layer. The outer diameter of development roller 4 is 19.6 mm.

Sponge roller 3 includes silicone foam rubber around a metal core. The middle part of sponge roller 3 has an outer diameter of 15.5 mm, and both ends thereof have an outer diameter of 14.8 mm. Sponge roller 3 is manufactured as follows. 100 parts by weight of silicone rubber KE151U (Shin-Etsu Chemical Co., Ltd, trade name) is mixed with 0.3 parts by weight of a low-temperature decomposition type organic peroxide vulcanizing agent C-1 (Shin-Etsu Chemical Co., Ltd, trade name), 3 parts by weight of a high-temperature decomposition type organic peroxide vulcanizing agent C-3 (Shin-Etsu Chemical Co., Ltd, trade name), and 9 parts by weight of an organic foaming agent KEP-13 (Shin-Etsu Chemical Co., Ltd, trade name) to prepare the silicone rubber compound. The prepared silicone rubber compound is extruded onto a stainless core body with an extruder to the amount necessary to form single sponge roller 3. The obtained product is heated at 200° C. in an IR furnace for 30 minutes to be vulcanized and foamed, followed by secondary vulcanization at 200° C. for four hours. Sequentially, the obtained product is ground with a cylinder grinder to remove the skin layer and equalize the outer diameter, thus obtaining sponge roller 3 including a foam body with a cell size of 600 μm in the surface.

Development blade 5 includes two stainless (SUS304B-TA) plates with a thickness of 0.08 mm which are bent with a bend radius of 0.275 mm and are laid on each other. As illustrated in FIG. 2, development blade 5 is placed so that the short side thereof is located upstream in the rotation direction of development roller 4 while the long side thereof is located downstream. Moreover, the bent portion of development blade 5 is in contact with development roller 4 with a certain degree of linear pressure (about 40 to 70 gf/cm) and slightly deforms.

Photoreceptive drum 7 includes a photoreceptive layer made of an organic compound on an aluminum tube material. The outer diameter of photoreceptive drum 7 is 29.95 mm.

In each of the rollers and drums, a gear for transmitting a driving force is fixed (not illustrated in FIG. 2) by press fitting or another method. The gear fixed to photoreceptive drum 7 is called a drum gear, the gear fixed to development roller 4 is called a development gear, the gear fixed to sponge roller 3 is called a sponge gear, the gear fixed to charge roller 8 is called a charge gear, and the gear provided between the development gear and sponge gear is called an idle gear.

Herein, when drive is transmitted to the drum gear through a not-shown motor and several not-shown gears located in the body of image formation apparatus 10, photoreceptive drum 7 rotates, and the drum gear transmits the drive to the development gear to rotate development roller 4. The development gear transmits the drive through the idle gear to the sponge gear to rotate sponge gear 3. The dram gear transmits the drive to the charge gear to rotate charge roller 8. The development process forming a developer image on the surface of the photoreceptive drum 7 is thus executed. The rotation direction of each rotating member is as illustrated in FIG. 2.

Next, a preparation example of toner 2 prepared by a grinding process is described below taking cyan (C) toner as an example.

A mixture of 100 parts by weight of a polyester resin (number average molecular weight: 3700, Tg: 62° C.) as a binder resin, 1 part by weight of a salicylate complex as a charge control agent, 3 parts by weight phthalocyanine blue (C. I. Pigment Blue 15:3) as a colorant, and 10 parts by weight of a release agent (Tg: 100° C.) is sufficiently stirred and blended in a mixer (Henschel mixer made by Mitsui Miike Chemical Engineering Machinery, Co., Ltd.). The obtained mixture is heated to melt and kneaded at a temperature of 100° C. for about three hours by an open roll type continuous kneader (Kneadex made by Mitsui Mining Co., Ltd.) and is cooled to room temperature. The kneaded product thus obtained is ground by a collision plate type mill using an air jet (Dispersion separator made by Nippon Pneumatic Mfg. Co., Ltd.). Thereafter, the obtained particles are classified by a wind rotor type dry air classifier (Micron separator made by Hosokawa Micron Corporation) using centrifugal force, and thus obtaining the base toner. 100 parts by weight of base toner is added with 1.0 parts by weight of hydrophobic silica fine powder R-972 (made by Nippon Aerosil Co., Ltd.), 1.5 parts by weight of hydrophobic silica fine powder RY-50 (made by Nippon Aerosil Co., Ltd.), and conductive fine particles of titanium oxide to be mixed by a mixer (Henschel mixer made by Mitsui Miike Chemical Engineering Machinery, Co., Ltd.). The mixture is sieved, thus preparing cyan toner.

Yellow tonner, magenta toner, and white toner can be obtained in the same manner by using pigment yellow 185, carmine, and titanium oxide mixed as the colorant, respectively. In the case of preparing the white toner, 30 parts by weight of titanium oxide is mixed to increase the contrast ratio.

As illustrated in FIG. 1, transfer rollers 20 to 23 individually made of conductive rubber or the like are located facing respective photoreceptive drums 7 of four image formation units 31 to 34 described above so as to be in pressure contact with photoreceptive drums 7. Transfer belt 17, which electrostatically adsorbs and transfers recording sheets 50, is interposed between transfer rollers 20 to 23 and photoreceptive drums 7. Transfer rollers 20 to 23 transfer developer images on respective photoreceptive drums 7 to recording sheet 50. In this transfer process, an electric potential is applied to provide a difference between the surface potential of each photoreceptive drum 7 and the surface potential of the corresponding one of transfer rollers 20 to 23 facing same photoreceptive drum 7.

Fixation device 40 includes a heating roller and a backup roller inside and pressurizes and heats the developer images transferred onto recording sheet 50. Moreover, the transfer process and fixation process are executed by rotationally driving transfer rollers 20 to 23 and the rollers of fixation device 40 using a not-shown motor and several gears of other systems within the body of image formation apparatus 10.

Figure 3:
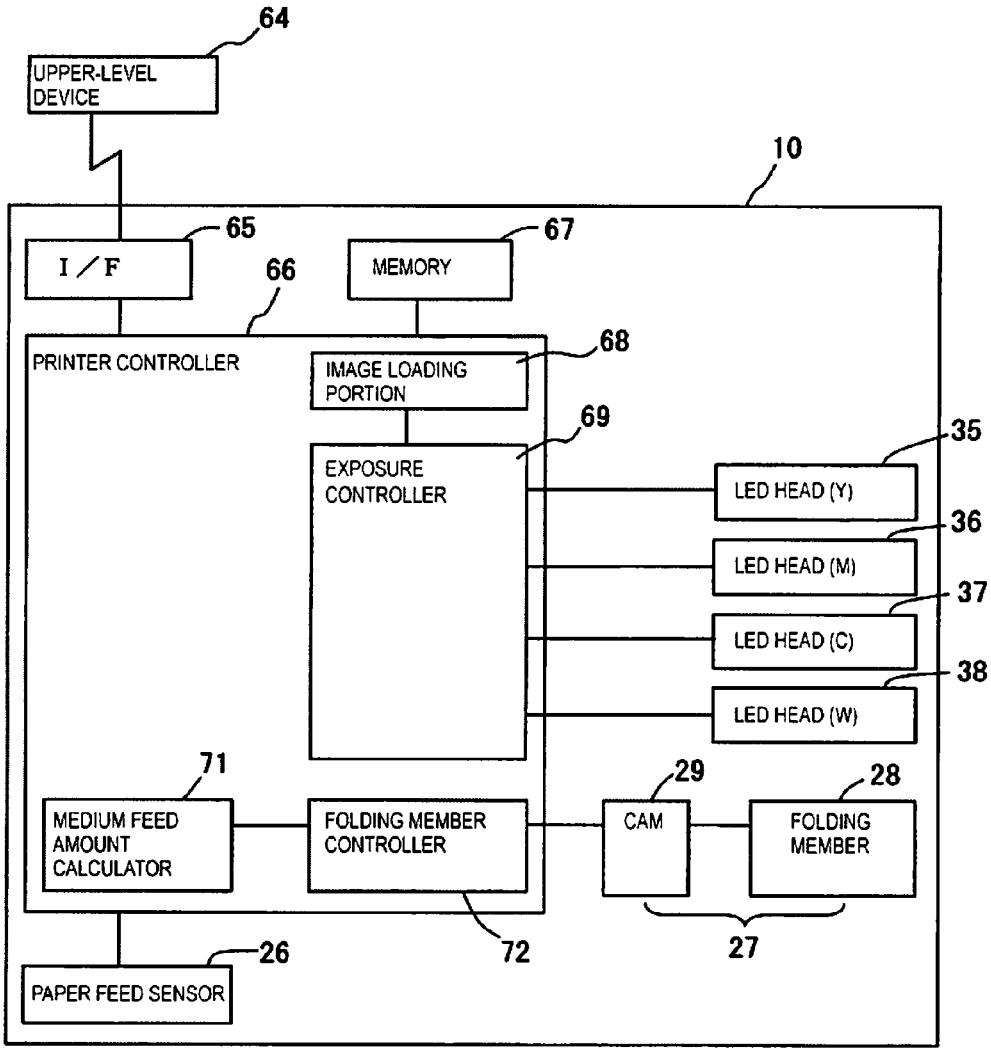
FIG. 3 is a block diagram illustrating the configuration of a main part of a control system controlling the operation of the image formation apparatus according to the invention.

FIG. 3 is a block diagram illustrating the configuration of a main part of a control system controlling the operation of image formation apparatus 10 according to the invention.

As illustrated in FIG. 3, printer controller 66 of image formation apparatus 10 is connected to external upper-level device (a personal computer, for example) 64 through I/F (interface) 65. Printer controller 66 includes image loading portion 68 and exposure controller 69. Image loading portion 68 loads image data sent from upper-level device 64 using memory 67. In accordance with the loaded image data, exposure controller 69 controls the exposure by LED head 35 for yellow (Y), LED head 36 for magenta (M), LED head 37 for cyan (C), and LED head 38 for white (W).

Pinter controller 66 further includes a medium feed amount calculator 71 and folding member controller 72. Medium feed amount calculator 71 is configured to calculate the feed amount of recording sheet 50 based on a signal from paper feed sensor 26 (FIG. 1) provided on the paper transport path. Folding member controller 72 is configured to control paper folding section 27 through a not-shown drive motor and gear train based on the value calculated by medium feed amount calculator 71. The folding member controller 72 rotationally drives cam 29 for controlling the up and down movement of folding member 28. Printer controller 66 is configured to further control image formation section 30, fixation device 40, paper transport rollers 45*a* to 45*x*, transport path switching guides 41 and 42, and the like for the printing operation of image formation apparatus 10. The description of the control configuration thereof is omitted.

LED heads 35 to 37 as a first exposure unit and image formation units 31 to 33 correspond to a first image formation section, and LED head 38 as a second exposure unit and image formation unit 34 correspond to a second image formation section.

In the aforementioned configuration, a description is given of the operation of image formation apparatus 10.

For an explanation of the basic operation of image formation apparatus 10, a description is given of a typical printing operation of image formation apparatus 10 excepting a later-described folding operation by paper folding section 27. Herein, it is assumed that folding member 28 is retracted to a position separated from transfer belt 17. Image formation units 31 to 34 are described by using the operation of image formation unit 34 including white (W) toner illustrated in FIG. 2 as an example.

As illustrated in FIG. 1, recording sheets 50 accommodated in recording sheet cassette 11 are picked up from recording sheet cassette 11 one by one in a direction of dotted arrow L (FIG. 1) by paper transport rollers 45*a* and 45*b*. Thereafter, each recording sheet 50 is transported along a not-shown recording sheet guide in a direction of dotted arrow E by paper transport rollers 45*c* and 45*d* and paper transport rollers 45*e* and 45*f* to image formation section 30 while the skew of recording sheet 50 is being corrected. Recording sheet 50 is fed to transfer belt 17, which is rotationally driven in the direction of arrow F in FIG. 1 by driving roller 18. The development process to form developer images on each photoreceptive drum 7, which is performed in image formation units 31 to 34, is started upon the detection of recording sheet 50 by paper feed sensor 26 in the process of transporting recording sheet 50 in the direction of dotted arrow E, for example.

In image formation section 30, the transfer process is performed as follows. As illustrated in FIG. 1, by transfer roller 20 which is located facing photoreceptive drum 7 across transfer belt 17 and is in pressure contact with the same, the developer image of yellow (Y) formed on photoreceptive drum 7 of image formation unit 31 for yellow (Y) by the aforementioned development process is first transferred onto recording sheet 50, electrostatically adsorbed to transfer belt 17 and transported.

Thereafter, recording sheet 50 is transported on transfer belt 17 along the arrow F direction in FIG. 1, and the developer image of magenta (M), developer image of cyan (C), and developer image of white (W) are sequentially transferred onto recording sheet 50 by image formation unit 32 and transfer roller 21, by image formation unit 33 and transfer roller 22, and by image formation unit 34 and transfer roller 23, respectively.

Recording sheet 50 with developer images of yellow, magenta, and cyan transferred thereon is transported toward fixation device 40 in the direction of arrow H in FIG. 1 and is then subjected to a fixation of the development images by fixation device 40. Recording sheet 50 is then transported in the direction of dotted arrow K in FIG. 1 by paper transport rollers 45*g* and 45*h* and paper transport rollers 45*i* and 45*j* and is then delivered to the outside of image formation apparatus 10.

In some cases, a small amount of toner 2 is not transferred and remains on the surfaces of receptive drums 7 after the transfer process. Remaining toner 2 is removed by cleaning blades 9 (FIG. 2). Photoreceptive drums 7 thus cleaned are repeatedly used.

Moreover, some insufficiently charged toner 2 is sometimes transferred from photoreceptive drums 7 of image formation units 31 to 34 illustrated in FIG. 1 to transfer belt 17 between sheets transported in a continuous paper feeding mode. Toner 2 transferred to transfer belt 17 is removed by transfer belt cleaning blade 24 and is reserved in waste developer tank 25 as transfer belt 17 rotationally moves along the directions of arrows F and R in FIG. 1. Transfer belt 17 thus cleaned is repeatedly used.

On the other hand, to print on both sides of recording sheet 50 by a double-sided printing mechanism of image formation apparatus 10, recording sheet 50 with developer images fixed on the front surface is once transported in the direction of dotted arrow M by transport path switching guide 41, paper transport rollers 45*k* and 45*l*, and paper transport rollers 45*x* and 45*w*, which are illustrated in FIG. 1. After the trailing edge of recording sheet 50 passes through transport path switching guide 42, the guiding direction of transport path switching guide 42 is switched, and recording sheet 50 is then transported in the direction of dotted arrow N by paper transport rollers 45*w* and 45*x* rotating in the opposite direction.

Recording sheet 50 is then transported sequentially in the direction of dotted arrow O by paper transport rollers 45*m* and 45*n* and paper transport rollers 45*o* and 45*p*, in the direction of dotted arrow P by paper transport rollers 45*q* and 45*r* and paper transport rollers 45*s* and 45*t*, and in the direction of dotted arrow Q in FIG. 1 by paper transport rollers 45*u* and 45*v*. Recording sheet 50 is then transported in the direction of dotted arrow E by paper transport rollers 45*c* and 45*d*, and developer image formation for the back surface is performed for the back surface opposite to the front surface with the developer images fixed first in the same manner as the aforementioned developer image formation for the front surface.

Next, a description is given of the operation of image formation apparatus 10 according to the invention, including paper folding operation by paper folding section 27.

In the process of using LED heads 35 to 38 to expose the surfaces of photoreceptive drums 7 uniformly charged by charge rollers 8 and form electrostatic latent images in image formation units 31 to 34, first, image data transmitted from the upper-level device 64 (which includes texts and figures that the user is actually seeing on the screen of a personal computer and wants to print, for example, and is hereinafter referred to as main print part data in some cases.) is loaded in image loading portion 68 (FIG. 3). By this loading, image loading portion 68 creates at least image data for each of the three colors (yellow, magenta, and cyan) which are used to process the main print part data with yellow, magenta, and cyan in the process of printing (which is hereinafter referred to as a real print data in some cases).

Image formation apparatus 10 of Embodiment 1 does not include an image formation unit for black toner as described above and accordingly represents black with so-called process black obtained by overprinting yellow, magenta, and cyan.

Subsequently, image loading portion 68 creates image data for white (hereinafter, sometimes referred to as real print data) used to print white toner in blanks of the loaded main print part data, that is, in a properly selected part of the region where none of yellow, magenta, and cyan is printed at the printing process of the main print part data.

Based on the real print data for yellow, magenta, cyan, and white created by image loading portion 68, exposure controller 69 sends to LED heads 35 to 38, light emission signals to cause LED heads 35 to 38 to emit light, respectively. Herein, it is assumed that each LED emits light when the received light emission signal is 1 and does not emit light when the received light emission signal is 0. Accordingly, exposure controller 69 sends 1 to LED head (W) 38 for a selected part (a print position) of the region where all the signals transmitted to the LED heads (Y) 35, LED heads (M) 36, and LED heads (C) 37 are 0.

A description is further given of the operation of image formation apparatus 10 according to the invention with reference to FIGS. 4 to 8.

Figure 4:
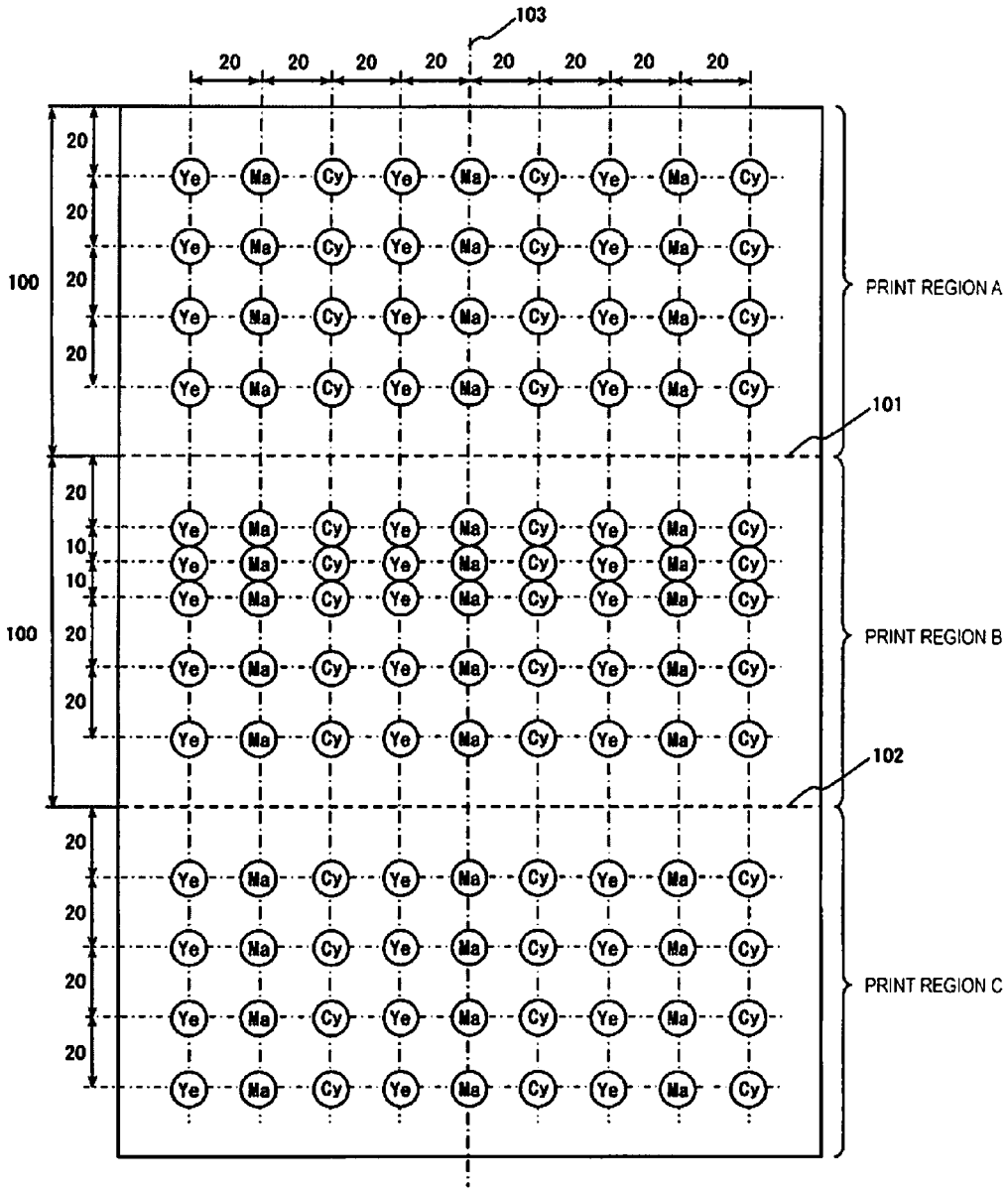
FIG. 4 is a virtual print diagram illustrated by assuming that the main print part data (front) sent from an upper-level device for the front surface of the recording sheet is really printed on the front surface of the recording sheet in Embodiment 1.
Figure 5:
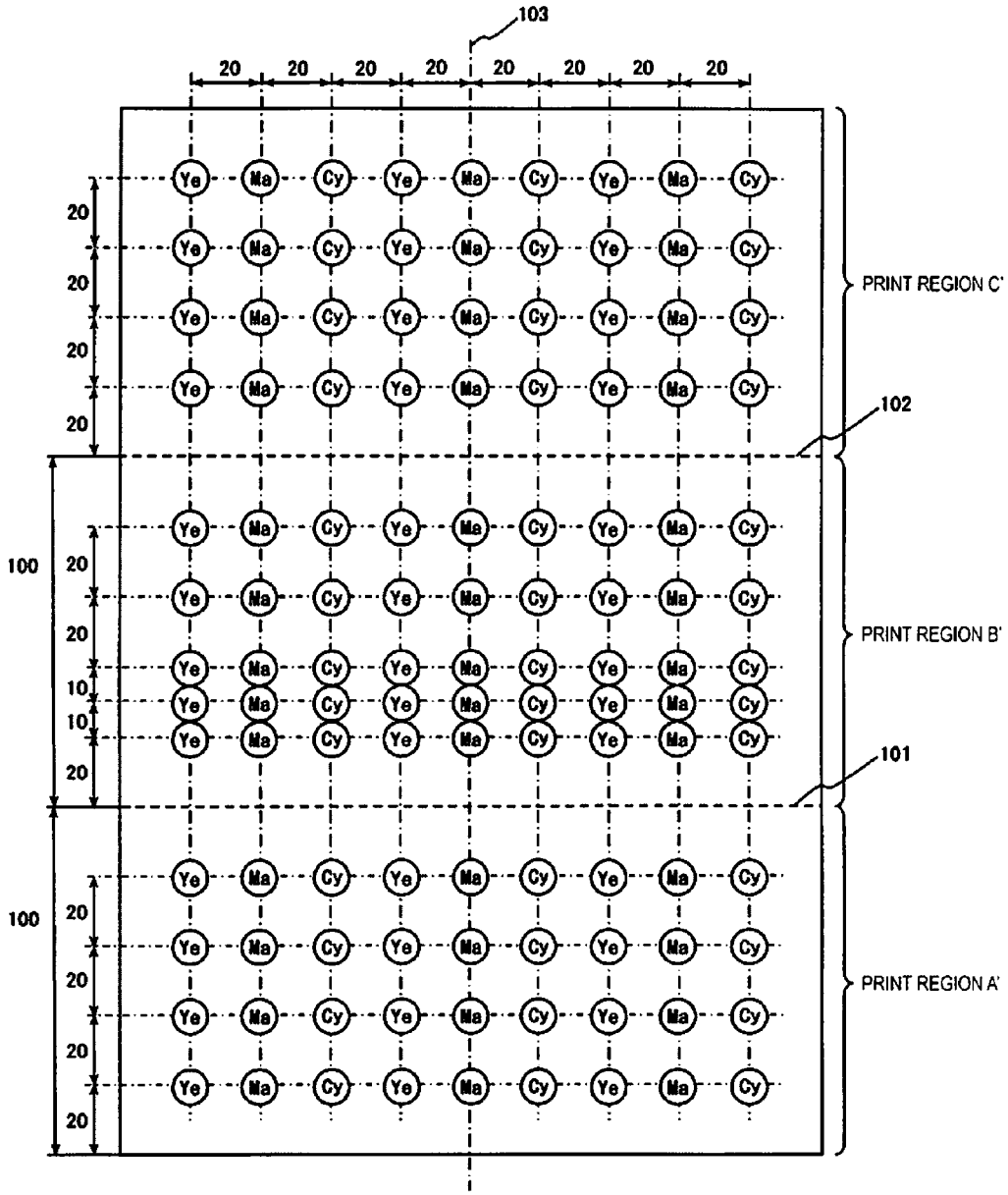
FIG. 5 is a virtual print diagram illustrated by assuming that the main print part data (back) sent from the upper-level device for the back surface of the recording sheet is really printed on the back surface of the recording sheet in Embodiment 1.

FIG. 4 is a virtual print diagram illustrated by assuming that the main print part data (front) sent from the upper-level device 64 for the front surface of recording sheet 50 as a print medium is really printed on the front surface of recording sheet 50 for easy understanding. FIG. 5 is a virtual print diagram illustrated by assuming that the main print part data (back) sent from the upper-level device 64 for the back surface of same recording sheet 50 is really printed on the back surface of recording sheet 50.

In FIG. 4, the rectangular thick solid line represents the outline of recording sheet 50 of A4 size, and the thick dotted lines represent fold lines. A, B, and C in FIG. 4 indicate print regions in the front surface. As described later, fold line 101 which is the boundary between portions A and B, and is located at a distance of 100 mm from the upper edge of recording sheet 50, represents a valley fold to be applied in the front surface of recording sheet 50. Fold line 102, which is the boundary between portions B and C and is at a distance of 200 mm from the upper edge of recording sheet 50, represents a mountain fold to be applied in the front surface of recording sheet 50. A', B', and C' in FIG. 5 indicate print regions in the back surface and respectively correspond to print regions A, B, and C in the front surface illustrated in FIG. 4.

As illustrated in FIG. 4, in print region A, a circle with a diameter of 10 mm is located on central line 103 of recording sheet 50, which is A4 size paper, at a distance of 20 mm from the upper edge thereof. The circle has a density obtained by a full exposure with LED head (M) 36. From the aforementioned magenta circle, circles with a diameter of 10 mm are arranged at intervals of 20 mm in the horizontal and vertical directions. The circles are formed with densities obtained by a full exposure of LED heads 35 to 37 corresponding to the colors indicated in the drawing. Ye, Ma, and Cy in the circles in FIG. 4 indicate the colors: yellow, magenta, and cyan, respectively.

Figure 6:
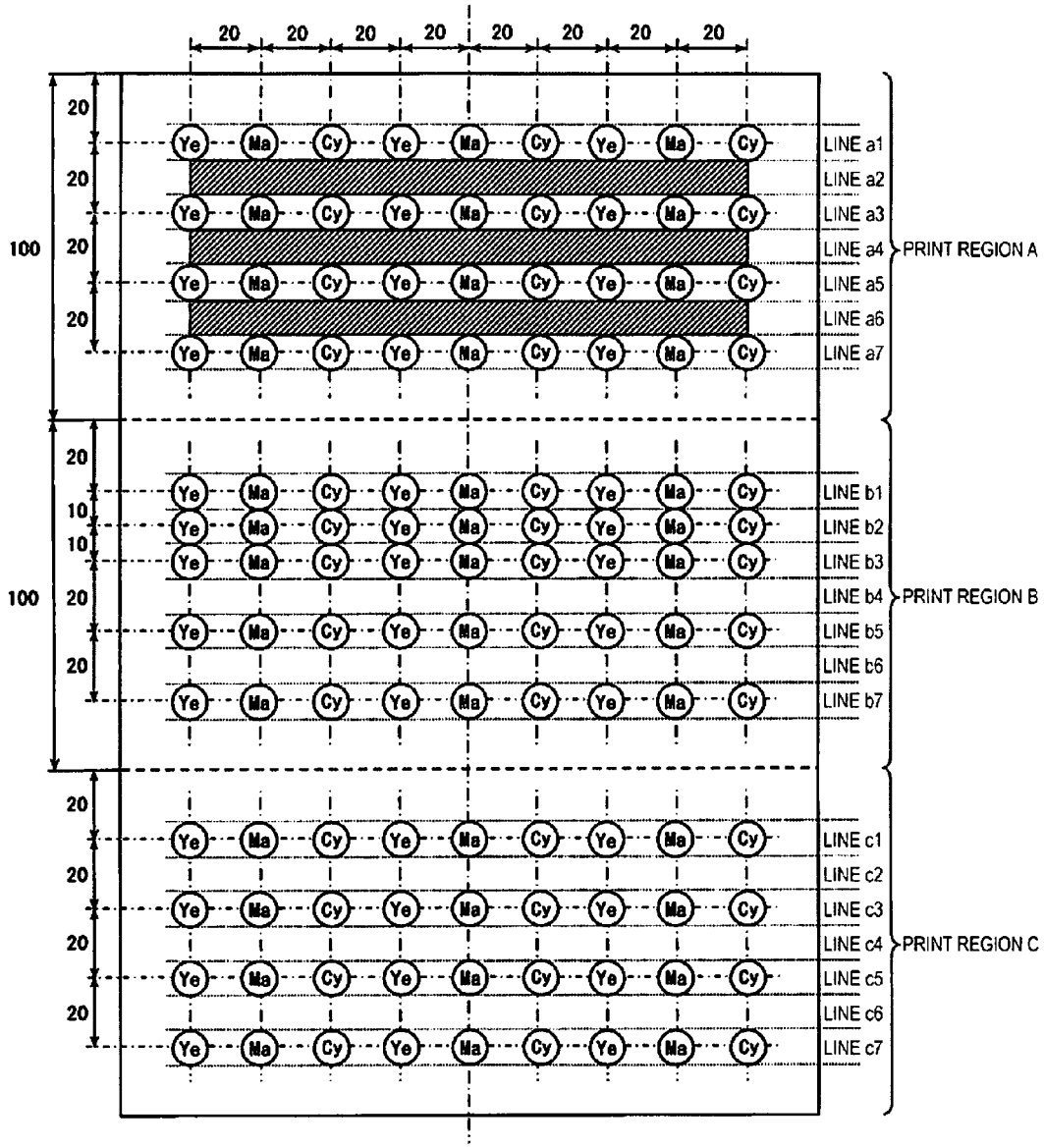
FIG. 6 is a virtual print diagram illustrated by assuming that the real print data formed at a predetermined printing time is really printed on the recording sheet in Embodiment 1.
Figure 7:
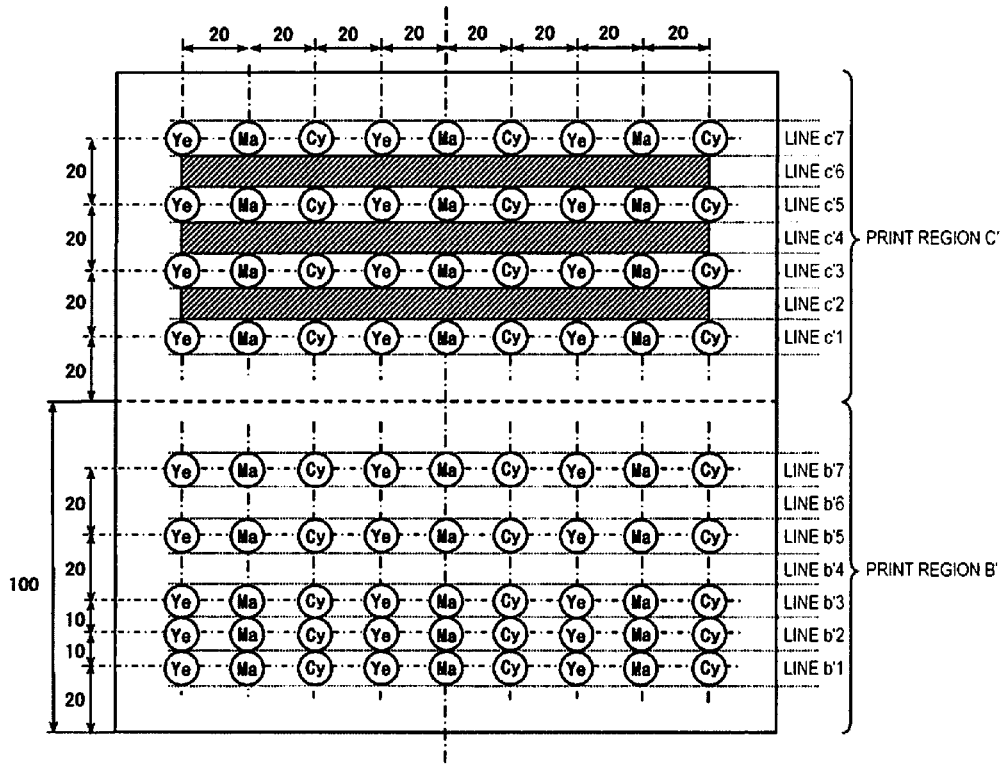
FIG. 7 is a virtual print diagram illustrated by assuming that the real print data formed at another predetermined printing time is really printed on the recording sheet in Embodiment 1.
Figure 8:
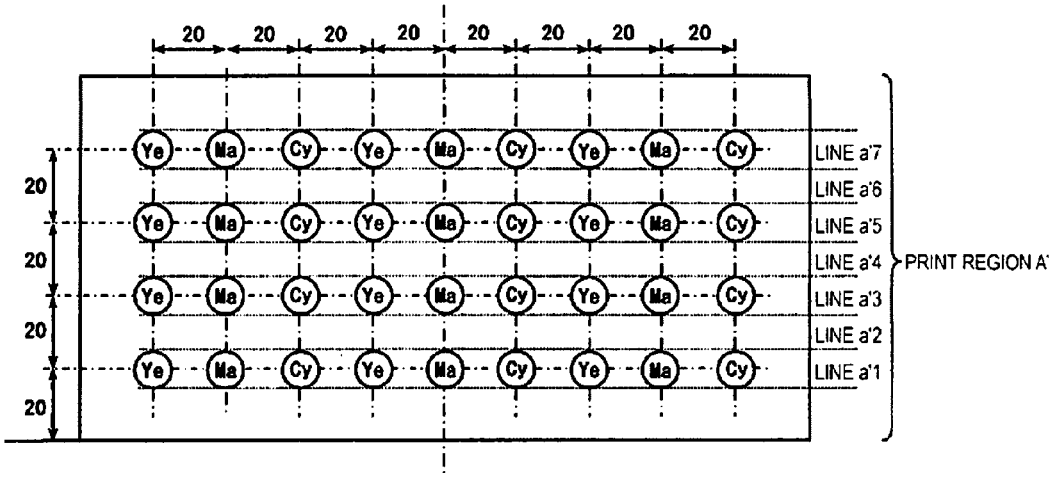
FIG. 8 is a virtual print diagram illustrated by assuming that the real print data formed at still another predetermined printing time is really printed on the recording sheet in Embodiment 1.

When receiving from upper-level device 64, and from the main print part data (front) illustrated in FIG. 4 and the main print part data (back) illustrated in FIG. 5, image loading portion 68 forms real print data illustrated in FIGS. 6 to 8. FIGS. 6 to 8 are virtual print diagrams illustrated by assuming that real print data formed at later-described printing times is really printed on recording sheet 50 for easy understanding.

As illustrated in FIG. 6, lines of print region A in the front surface of recording sheet 50 are indicated by a1 to a7. Image loading portion 68 creates real print data to form ϕ10 mm circles on lines a1, a3, a5, and a7 with densities obtained by a full exposure with LED heads 35 to 38 corresponding to the illustrated colors and creates real print data to form white toner images by an exposure with LED head (W) 38 in the shaded diagonal portions on lines a2, a4, and a6, where the circles are not formed.

As for print regions B and C in the front surface of recording sheet 50 illustrated in FIG. 6 and print regions C', B', and A' in the back surface of recording sheet 50 illustrated in FIGS. 7 and 8, image loading portion 68 also creates real print data to form ϕ10 mm circles on predetermined lines with densities obtained by a full exposure by LED heads 35 to 37 corresponding to the illustrated colors and creates real print data to form white toner images in the shaded diagonal portions by exposure with LED head (W) 38 on lines c'6, c'4, and c'2, where the circles are not formed.

In this embodiment, white toner images are used as an adhesion means as described later and are therefore formed at minimal places. For example, as described later, recording sheet 50 is folded so that print regions A and B face each other and print regions C' and B' face each other. Print regions A and B adhere to each other by white toner images, and print regions C' and B' adhere to each other by the white toner images. Although white toner images may be formed on both surfaces that adhere to each other, the real print data is created herein so that white toner images are formed only in print regions A and C', each corresponding to one of the surfaces that adhere to each other.

Herein, the real print data to form ϕ10 mm circles also on line b2 in print region B illustrated in FIG. 6 with densities obtained by full exposure with LED heads 35 to 37 corresponding to the colors of the circles is created based on the main print part data (front) of print region B in FIG. 4. The real print data to form ϕ10 mm circles on line b'2 in print region B' illustrated in FIG. 7 with densities obtained by a full exposure with LED heads 35 to 37 corresponding to the colors of the circles also is created based on the main print part data (back) of print region B' illustrated in FIG. 7.

In the above description, the white toner images are formed between lines on which yellow, magenta, and cyan circles are arranged. However, white toner images may be also formed between columns on which yellow, magenta, and cyan circles are arranged in addition to between the lines, or may be formed only between the columns.

Next, a description is given of the folding and printing operation of image formation apparatus 10 according to the invention, including the paper folding operation by paper folding section 27. FIGS. 9A to 9E are process diagrams given for explaining the folding operation and the state of recording sheet 50 at each step of the printing process.

Circular print portions 105 in FIG. 9 are toner images corresponding to ϕ10 mm circles with densities obtained by a full exposure by LED heads 35 to 37 corresponding to the indicated colors (FIGS. 6 to 8). Rectangular white print region 106 in FIG. 9 is a white toner image corresponding to the rectangular shaded portion exposed by LED head (W) 38, which is illustrated in FIGS. 6 to 8. FIG. 9 does not illustrate all of the toner images corresponding to the ϕ10 mm circles and shaded portions illustrated in FIGS. 6 to 8 for simplification.

White toner images are used as an adhesion means as described later. Accordingly, developer images developed by image formation unit 34 is referred to as white toner images while developer images which are developed by image formation units 31 to 33 to form images are referred to as toner images in some cases for discrimination therebetween in the following description.

Figure 9B:
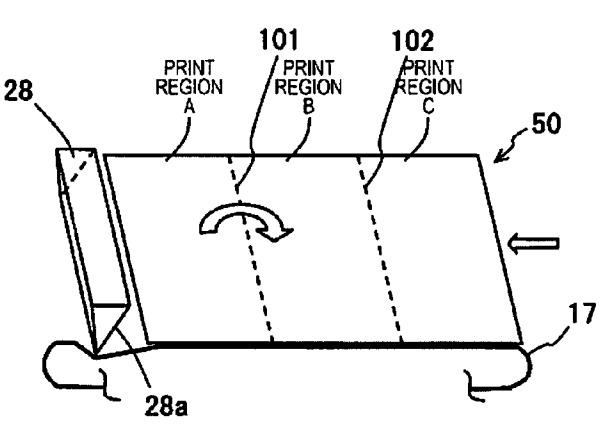
FIGS. 9A to 9E are process diagrams given for explaining the folding operation and the state of the recording sheet at each step of the printing in Embodiment 1.
Figure 9A:
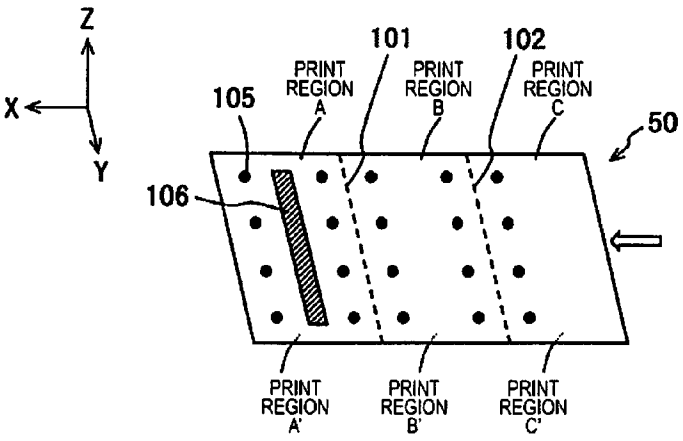

FIG. 9A illustrates the state of recording sheet 50 which is taken out of recording sheet cassette 11 and transported to image formation section 30 where toner images and white toner images are transferred to the upper side thereof (the front surface herein) before the leading edge thereof reaches paper folding section 27. To be specific, in print regions A, B, and C in the front surface of recording sheet 50, toner images and white toner images formed based on the real print data of the print regions A, B, and C illustrated in FIG. 6 are transferred.

As illustrated in FIG. 9B, the leading edge of recording sheet 50 transported by transfer belt 17 then comes into contact with slant surface 28*a* of folding member 28, which is in pressure contact with transfer belt 17 so as to be slightly pressed in, and then rolls up along slant surface 28*a*. Recording sheet 50 is therefore folded so that print region A is laid on print region B. For smooth folding in the above step, recording sheet 50 is preferably creased at fold lines 101 and 102 in predetermined directions in advance.

Figure 9E:
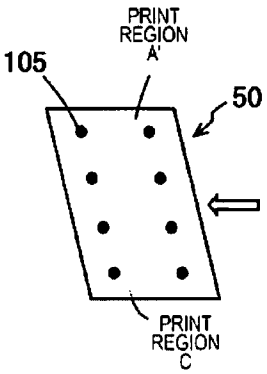

Medium feed amount calculator 71 (FIG. 3) calculates the feed amount of recording sheet 50 based on a signal from paper feed sensor 26. When the calculated feed amount becomes equal to the length of print region A in the feeding direction (corresponding to the time when fold line 101 reaches slant surface 28*a*), folding member controller 72 (FIG. 3) rotates cam 29 to raise folding member 28 as illustrated in FIG. 9C. Folding member 28 thereby separates from transfer belt 17, and recording sheet 50 with print region A folded is transported between folding member 28 and transfer belt 17 to fixation device 40 for the first fixation.

In the step (1) so far, print regions A and B adhere to each other with the white toner images, and the toner images transferred to print regions A, B, and C are fixed on recording sheet 50. Herein, the white toner images work as an adhesion means capable of implementing temporary adhesion.

Recording sheet 50 already subjected to the aforementioned step (1) is transported sequentially in the order of: (M), (N), (O), (P), (Q), and (E) by using the double-sided printing mechanism of image formation apparatus 10, that is, by transport path switching guides 41 and 42 and paper transport rollers 45*k* to 45*x* as indicated by dotted allows E and M to Q.

Recording sheet 50 is subjected to step (2) with the upper and lower sides reversed and the leading and trailing edges reversed.

Figure 9D:
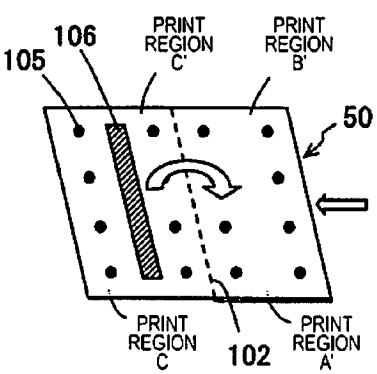
Figure 9C:
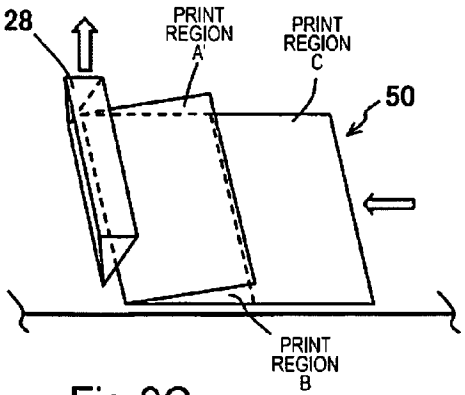

FIG. 9D illustrates the state of recording sheet 50 which is transported by the double-sided printing mechanism and reaches image formation section 30 again before the leading edge thereof reaches paper folding section 27. On the upper side thereof, toner images and white toner images formed based on the real print data illustrated in FIG. 7 are transferred. Herein, print region C' in the back surface of recording sheet 50 is on the leading side, and print regions C' and B' are in the upper side. In the upper side of recording sheet 50, the toner images and white toner images formed based on the real print data of the print regions C' and B' illustrated in FIG. 7 are transferred. In this process, print regions A and B facing each other are laid on and adhere to each other, and print regions C and A' are in the lower side facing the transfer belt 17.

As passing under folding member 28, recording sheet 50 already subjected to the transfer to print regions B' and C' is, similarly to the aforementioned step (1), folded at fold line 102 so that print region C' is laid on print region B'. Recording sheet 50 is then transported to fixation device 40 for the second fixation. In the step (2) so far, print regions C' and B' adhere to each other by the white toner images, and the toner images transferred to print regions C' and B' are fixed to recording sheet 50.

Recording sheet 50, already subjected to the aforementioned step (2), is again transported sequentially in the order of: (M), (N), (O), (P), (Q), and (E) for step (3) by again using the double-sided printing mechanism of image formation apparatus 10, that is, by transport path switching guides 41 and 42 and paper transport rollers 45*k* to 45*x* as indicated by dotted allows E and M to Q.

FIG. 9E illustrates the state of recording sheet 50 which is transported to image formation section 30 again by the double-sided printing mechanism before the leading edge thereof reaches paper folding section 27. On the upper side thereof, toner images formed based on the real print data illustrated in FIG. 8 are transferred. Herein, print region A' of the back surface in recording sheet 50 is in the upper side. In the upper side of recording sheet 50, the toner images formed based on the real print data of the print region A' illustrated in FIG. 8 are transferred. In this process, print regions A and B facing each other are laid on and adhere to each other, and print data C' and B' facing each other are laid on and adhere to each other. Print region C is therefore positioned in the lower side facing the transfer belt 17.

Recording sheet 50 which is already subjected to a transfer to print region A' does not need to be folded again, and no white toner image is transferred to print region A'. Recording sheet 50 passes under folding member 28 which is separated from transfer belt 17 and is located at the highest position that allows passage of recording sheet 50. Recording sheet 50 is then transported to fixation device 40 for the third fixation.

Recording sheet 50, already subjected to step (3), is guided to paper transport rollers 45*g* and 45*h* by transport path switching guide 41 with the guiding direction changed and is transported in the direction of dotted arrow K in FIG. 1 by paper transport rollers 45*g* and 45*h* and paper transport rollers 45*i* and 45*j*. Recording sheet 50 is then delivered to the outside of image formation apparatus 10.

Recording sheet 50 which is delivered to the outside has both sides printed and is folded in three sections adhering to one another (hereinafter, sometimes referred to as a double-sided trifold printing). Print regions A and B (print regions C' and B') just adhere to each other with white toner. Accordingly, print regions A and B (print regions C' and B') can be separated by human power if necessary and once separated, cannot adhere to each other again even if laid on each other (unless recording sheet 50 passes through fixation section again).

Figure 10:
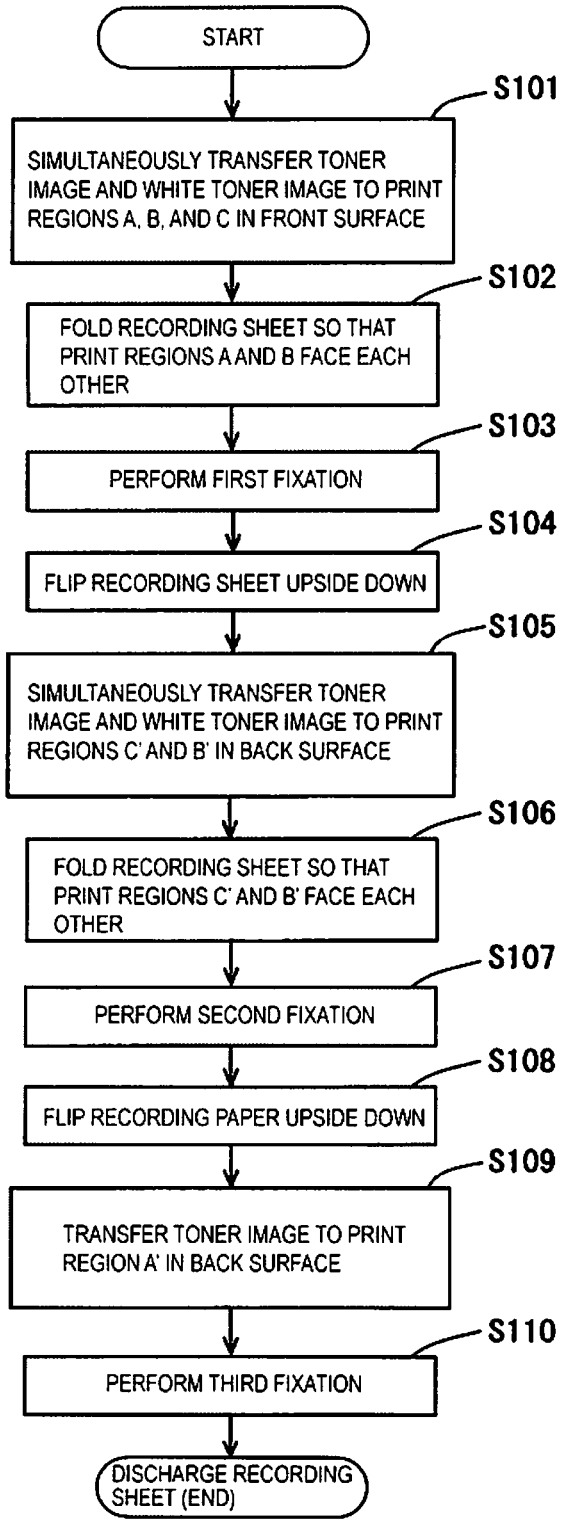
FIG. 10 is an entire flowchart of double-sided trifold printing performed by the image formation apparatus in Embodiment 1.

FIG. 10 is a flowchart of an entire flow of the aforementioned double-sided trifold printing performed by image formation apparatus 10. The summary thereof is described with reference to the flowchart.

When the printing process starts, image formation apparatus 10, first in image formation section 30, transfers toner images formed by image formation units 31 to 33 based on the real print data illustrated in FIG. 6 to print regions A, B, and C in the front surface of recording sheet 50, which is taken out of recording sheet cassette 11 and transported to image formation section 30. Secondly, image formation apparatus 10 transfers white toner images formed by image formation unit 34 based on the real print data illustrated in FIG. 6 to print region A in the front surface (step S101). The toner images and white toner images are transferred when recording sheet 50 passes through image formation section 30 once. This is sometimes represented as the toner images and white toner images are simultaneously transferred.

Image formation apparatus 10 subsequently folds recording sheet 50 with paper folding section 27 (FIG. 1) so that print regions A and B in the front surface are laid on each other so as to face each other as illustrated in FIG. 9C (step S102) and is subjected to the first fixation by fixation device (step S103). Image formation apparatus 10 then flips recording sheet 50 upside down and reverses the leading and trailing edges thereof (step S104). Image formation apparatus 10 transports recording sheet 50 to image formation section 30 again.

By image formation section 30, image formation apparatus 10 simultaneously transfers the toner images and white toner images, which are formed based on the real print data illustrated in FIG. 7, to print regions C' and B' in the back surface of recording sheet 50, which is in the upper side at the current passage (step S105). As illustrated in FIG. 9D, image formation apparatus 10 folds recording sheet 50 so that printed regions C' and B' in the back surface are laid on each other so as to face each other (step S106) and performs the second fixation for recording sheet 50 by fixation device 40 (step S107).

Thereafter, image formation apparatus 10 flips recording sheet 50 upside down and reverses the leading and trailing edges thereof by the double-sided printing mechanism (step S108). Image formation apparatus 10 then transports recording sheet 50 to image formation section 30 again. At the current passage in image formation section 30, image formation apparatus 10 transfers the toner images which are formed based on the real print data illustrated in FIG. 8 to print regions A' in the back surface of recording sheet 50, which is in the upper side as illustrated in FIG. 9E (step S109). Image formation apparatus 10 then performs the fourth fixation for recording sheet 50 by fixation device 40 (step S110). Image formation apparatus 10 delivers recording sheet 50 double-sided trifold printed to the outside of the apparatus.

According to the aforementioned processing method, printing and adhesion can be simultaneously performed by a series of steps. Moreover, the image regions where the white toner images are formed do not overlap the image regions where the toner images are formed, so that the white toner images are not mixed with the toner images at the printing process. Furthermore, the white toner images and the toner images are transferred onto the same surface simultaneously, thus shortening the printing and adhesion time.

Figure 11:
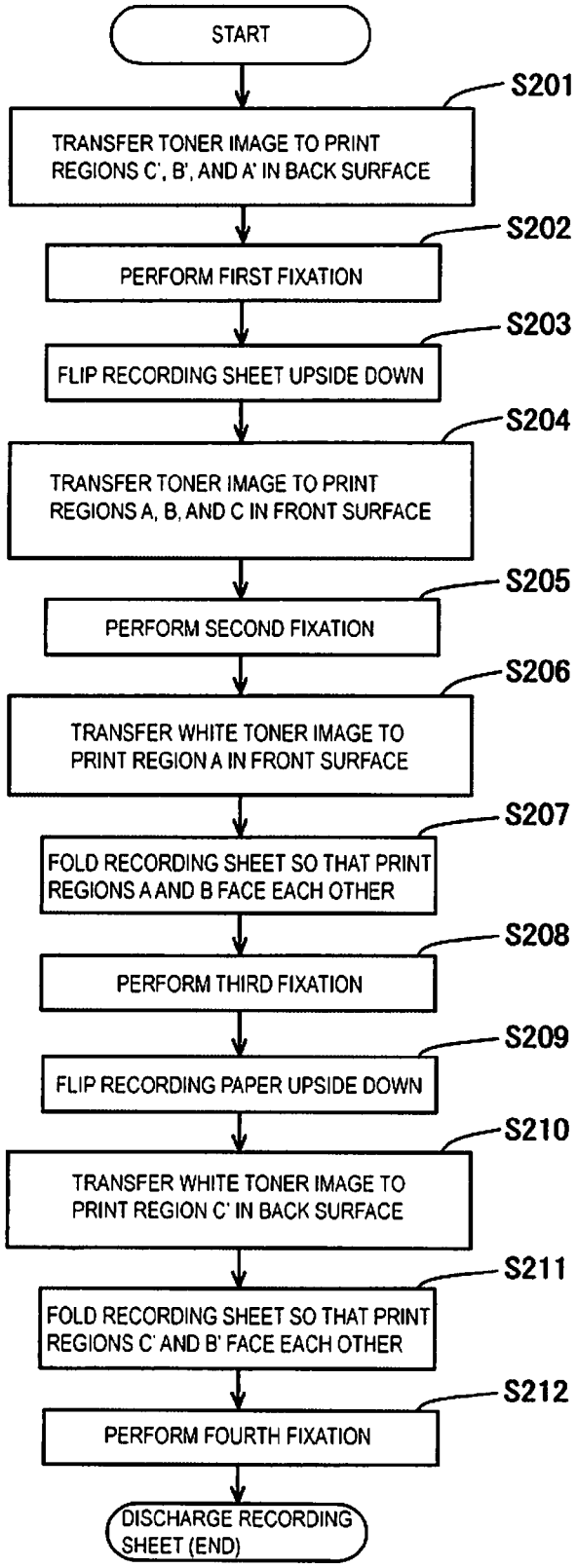
FIG. 11 is an entire flowchart of double-sided trifold printing of Modification 1, which is performed by the image formation apparatus in Embodiment 1.

FIG. 11 is a flowchart illustrating the entire flow of double-sided trifold printing of Modification 1 performed by image formation apparatus 10 in Embodiment 1. The summary thereof is described with reference to the flowchart.

When the printing process starts, at first by image formation section 30, image formation apparatus 10 transfers toner images developed by image formation units 31 to 33 to form images in print regions C', B', and A' in the back surface of recording sheet 50, to print regions C', B', and A' in the back surface of recording sheet 50 which is taken out of recording sheet cassette 11 and transported to image formation section 30 (step S201). Herein, the toner images are formed based on the real print data of the print regions C', B', and A' illustrated in FIGS. 7 and 8, excepting the real print data to form the white toner images represented by the rectangular shaded portions, for example.

Herein, the process starts from printing on the back surface of recording sheet 50. In this case, the upper and lower surfaces of recording sheets 50 placed in recording sheet cassette 11 are reversed to those in the aforementioned embodiment, or the printing process may be started after the recording sheet 50 is flipped upside down using the double-sided printing mechanism of image formation apparatus 10. These processes are not required when it is unnecessary to discriminate the front and back surfaces of recording sheet 50.

Subsequently, image formation apparatus 10 causes recording sheet 50 to pass under paper folding section 27 without operating paper folding section 27 and performs the first fixation for recording sheet 50 by fixation device 40 (step S202). Image formation apparatus 10 then flips recording sheet 50 upside down and reverses the leading and trailing edges thereof (step S203). Image formation apparatus 10 transports the same to image formation section 30 again.

At the current passage in image formation section 30, image formation apparatus 10 transfers toner images which are developed by image formation units 31 to 33 to form images in print regions A, B, and C in the front surface of recording sheet 50 to print regions A, B, and C in the front surface of recording sheet 50 (step S204). The toner images herein are based on the real print data of print regions A, B, and C illustrated in FIG. 6, excepting the real print data to form the white toner images represented by the rectangular shaded portions, for example.

Thereafter, image formation apparatus 10 causes recording sheet 50 to pass under paper folding section 27 without operating the same and performs the second fixation for recording sheet 50 by fixation device 40 (step S205). Image formation apparatus 10 then transports recording sheet 50 to image formation section 30 again without flipping the same.

At the current passage in the image formation section 30, image formation apparatus 10 transfers the white toner images, which are developed by the image formation unit 34 to serve as an adhesion means in print region A in the front surface of recording sheet 50, to print region A (step S206). Herein, the white toner images are based on the real print data to form the white toner images indicated by the rectangular shaded portions in the real print data of the print region illustrated A in FIG. 6, for example.

As illustrated in FIG. 9C, image formation apparatus 10 folds recording sheet 50 by paper folding section 27 so that printed regions A and B in the front surface are laid on each other so as to face each other (step S207) and performs the third fixation for recording sheet 50 by fixation device 40 (step S208). Image formation apparatus 10 then flips recording sheet 50 upside down and reverses the leading and trailing edges by the double-sided printing mechanism (step S209). Image formation apparatus 10 transports recording sheet 50 to image formation section 30 again.

At the current passage in image formation section 30, image formation apparatus 10 transfers the white toner images which are developed by the image formation unit 34 to serve as an adhesion means in print region C' in the back surface of recording sheet 50, to print region C' (step S210). Herein, the white toner images are based on the real print data to form the white toner images represented by the rectangular shaded portions among the real print data of print region C' illustrated in FIG. 7, for example.

As illustrated in FIG. 9D, image formation apparatus 10 folds recording sheet 50 by paper folding section 27 so that print regions C' and B' in the back surface are laid on each other so as to face each other (step S211) and performs the fourth fixation for recording sheet 50 by fixation device 40 (step S201). Image formation apparatus 10 thus delivers recording sheet 50 which is double-sided trifold printed to the outside.

According to the aforementioned processing method, toner images to form images are fixed before the folding process. Accordingly, it is possible to prevent the toner images from being fixed to the opposite surface by folding.

Figure 12:
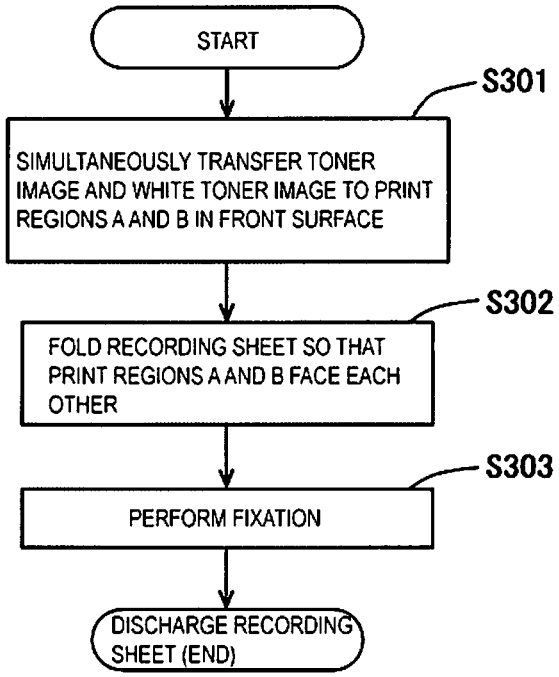
FIG. 12 is an entire flowchart of single-side bifold printing of Modification 2, which is performed by the image formation apparatus in Embodiment 1.

FIG. 12 is a flowchart illustrating the entire flow of single-side bifold printing of Modification 2, which is performed by image formation apparatus 10 in Embodiment 1. With reference to the flowchart, the summary thereof is described. Herein, the single-side bifold printing corresponds to a printing process of printing on one side and folding the printed sheet in two with the printed side facing in for adhesion.

Herein, single-side printing is performed, and each print is folded in two. Accordingly, with reference to FIGS. 4 and 5, it is assumed that, in FIG. 4, for example, the data of print region C is eliminated from the main print data (front) sent for the front surface of recording sheet 50 and the print region in the front surface is occupied by print regions A and B. Moreover, the recording sheet 50 includes only fold line 101. On the other hand, printing on the back surface is not performed, and the following description is given by assuming that there is no main print part data (back) sent for the back surface of recording sheet 50 illustrated in FIG. 5.

When the process starts in the flowchart of FIG. 12, by image formation section 30, image formation apparatus 10 first transfers the toner images formed by image formation units 31 to 33 based on the real print data illustrated in print regions A and B of FIG. 6, to print regions A and B in the front surface of recording sheet 50 which is taken out of recording sheet cassette 11 and transported to image formation section 30. Subsequently, image formation apparatus 10 transfers white toner images formed by image formation unit 34 based on the real print data illustrated in print region A of FIG. 6 to print region A in the front surface (step S301). The toner images and white toner image are transferred when recording sheet 50 passes through image formation section 30 one time. This process is therefore represented as the toner images and white toner images are simultaneously transferred in some cases.

Thereafter, image formation apparatus 10 folds recording sheet 50 by paper folding section 27 so that print regions A and B in the front surface are laid on each other so as to face each other (step S302) and performs fixation for recording sheet 50 by fixation device 40 (step S303). Image formation apparatus 10 delivers recording sheet 50 which is single-side bifold printed, to the outside.

According to the aforementioned processing method, printing and adhesion can be simultaneously performed by a series of steps. Moreover, the image regions where the white toner images are formed do not overlap the image regions where the toner images are formed, so that the white toner images are not mixed with the toner images at the printing process. Furthermore, the white toner images and the toner images are transferred onto the same surface simultaneously, thus shortening the printing and adhesion time.

Figure 13:
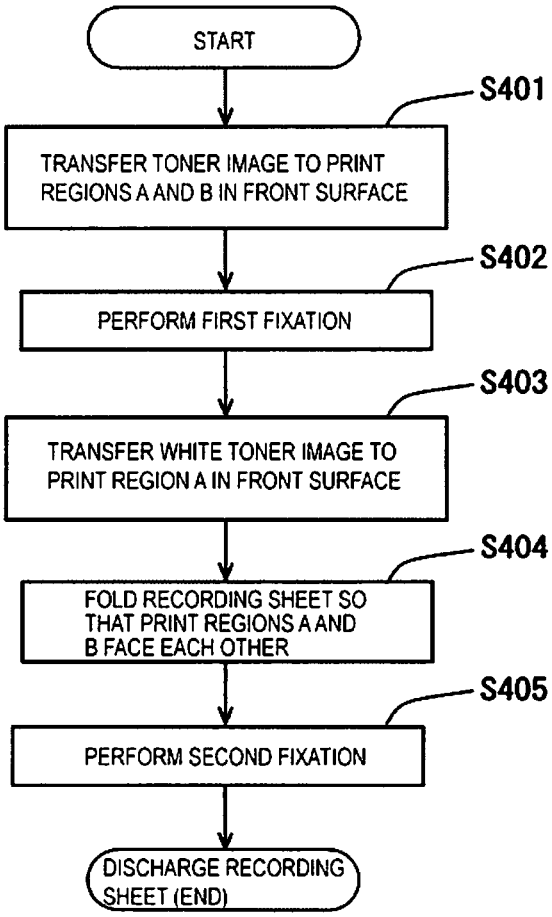
FIG. 13 is an entire flowchart of single-side bifold printing of Modification 3, which is performed by the image formation apparatus in Embodiment 1.

FIG. 13 is a flowchart illustrating the entire flow of single-side bifold printing of Modification 3, which is performed by image formation apparatus 10 in Embodiment 1. With reference to the flowchart, the summary thereof is described.

In modification 3, similar to Modification 2, single-side printing is performed, and each print is folded in two. Accordingly, with reference to FIGS. 4 and 5, it is assumed that in FIG. 4, for example, the data of print region C is eliminated from the main print part data (front) sent for the front surface of recording sheet 50 and the print region in the front surface is occupied by print regions A and B. Moreover, the recording sheet 50 includes only fold line 101. On the other hand, printing for the back surface is not performed, and the following description is given by assuming that there is no main print part data (back) sent for the back surface of recording sheet 50 illustrated in FIG. 5.

Accordingly, when the process starts in the flowchart of FIG. 13, by image formation section 30, image formation apparatus 10 first transfers the toner images that are developed by image formation units 31 to 33 to form images in print regions A and B in the front surface of recording sheet 50, to print regions A and B in the front surface of recording sheet 50 which is taken out of recording sheet cassette 11 and transported to image formation section 30 (step S401). Herein, the toner images are based on the real print data of print regions A and B illustrated in FIG. 6, for example, excepting the real print data to form the white toner images represented by the rectangular shaded portions.

Thereafter, image formation apparatus 10 causes recording sheet 50 to pass without operating paper folding section 27 and performs the first fixation for recording sheet 50 with fixation device 40 (step S402). Image formation apparatus 10 directly transports recording sheet 50 to image formation section 30 again without flipping recording sheet 50 by the double-sided printing mechanism.

At the current passage in the image formation section 30, image formation apparatus 10 transfers the white toner images, which are developed by the image formation unit 34 to serve as an adhesion means in print region A in the front surface of recording sheet 50, to print region A in the front surface of recording sheet 50 as the upper side (step S403). Herein, the white toner images are based on the real print data to form the white toner images represented by the rectangular shaded portions among the real print data of print regions A and B illustrated in FIG. 6, for example.

Image formation apparatus 10 folds recording sheet 50 by paper folding section 27 so that printed regions A and B in the front surface are laid on each other so as to face each other (step S404) and performs the second fixation for recording sheet 50 by fixation device 40 (step S405). Image formation apparatus 10 delivers recording sheet 50, which is thus single-side bifold printed, to the outside.

According to the aforementioned processing method, the toner images to form images are fixed before the folding process. It is therefore possible to prevent the toner images from being fixed to the opposite surface at folding.

As described above, according to the image formation apparatus of Embodiment 1, the printing process to print images on recording sheet 50 and the folding process to fold the recording sheet 50 for adhesion of the folded portion can be performed by the series of processes.

Embodiment 2

An image formation apparatus of Embodiment 2 differs from image formation apparatus 10 of Embodiment 1 mainly in a data processing method by image loading portion 68 of printer controller 66 illustrated in FIG. 3. Accordingly, the drawings and description of the same portions of the image formation apparatus of Embodiment 2 as those of image formation apparatus 10 of Embodiment 1 described above are omitted, and the following description is focused on the different point. The configuration of the main part of Embodiment 2 is externally similar to image formation apparatus 10 of Embodiment 1 illustrated in FIGS. 1 to 3, and for simplification, the description of Embodiment 2 refers to FIGS. 1 to 3 when needed.

Figure 14:
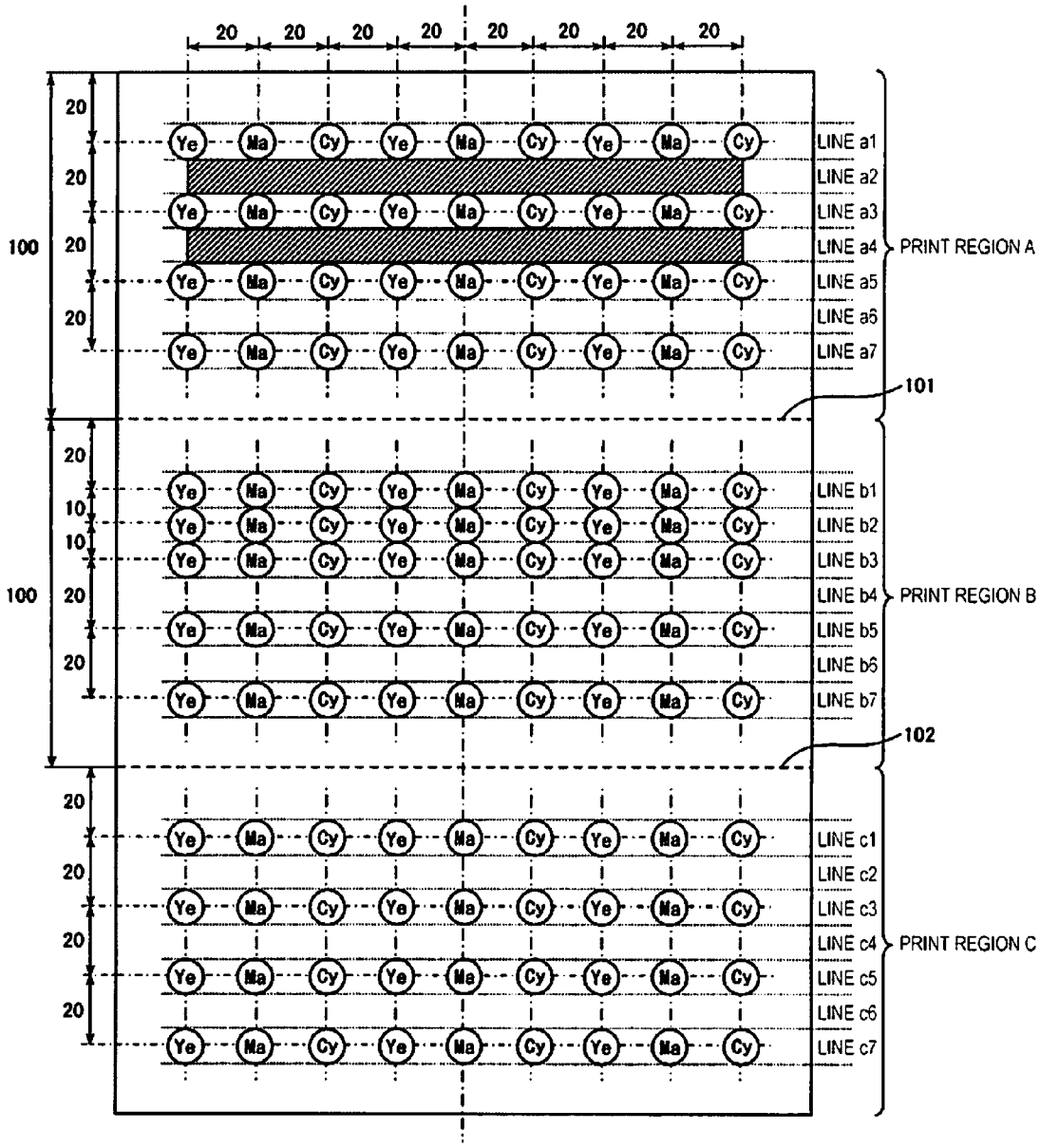
FIG. 14 is a virtual print diagram illustrated by assuming that the real print data formed at a predetermined printing time is really printed on the recording sheet in Embodiment 2.
Figure 15:
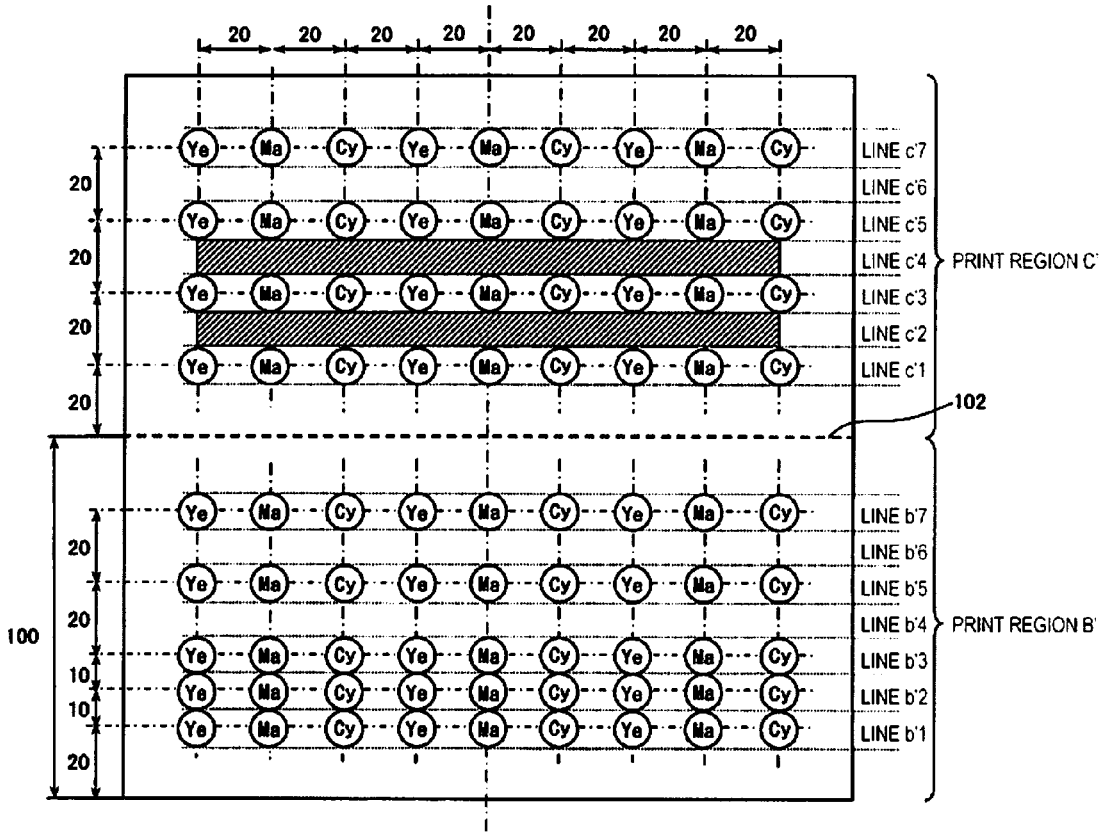
FIG. 15 is a virtual print diagram illustrated by assuming that the real print data formed at another predetermined printing time is really printed on the recording sheet in Embodiment 2.
Figure 16:
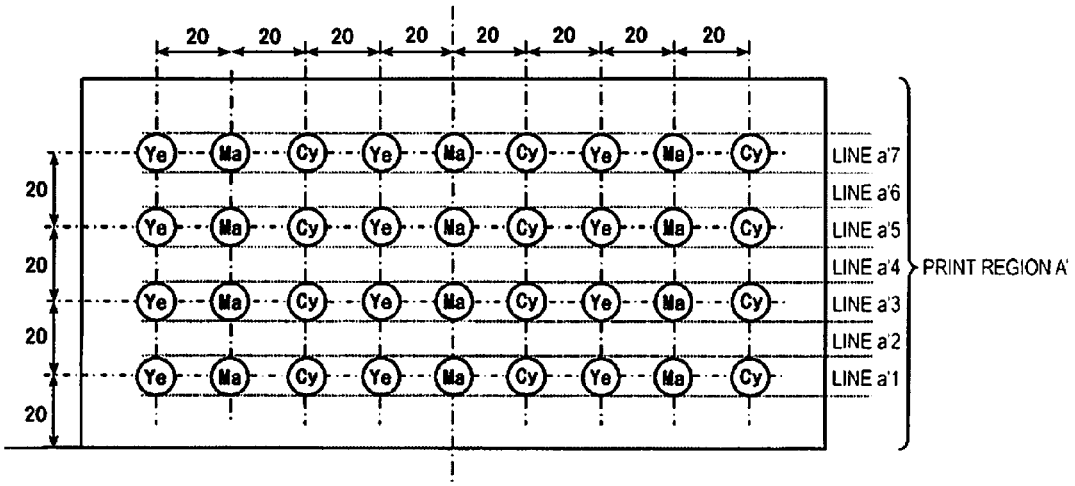
FIG. 16 is a virtual print diagram illustrated by assuming that the real print data formed at still another predetermined printing time is really printed on the recording sheet in Embodiment 2.

FIGS. 14 to 16 are virtual print diagrams of real print data formed by image loading portion 68 in Embodiment 2.

When receiving main print part data (front) illustrated in FIG. 4 and main print part data (back) illustrated in FIG. 5 from upper-level device 64, image loading portion 68 creates real print data illustrated in FIGS. 14 to 16. For easy understanding, FIGS. 14 to 16 are virtual print diagrams illustrated by assuming that real print data formed at certain printing times described later is actually printed on recording sheet 50.

As illustrated in FIG. 14, the lines of print regions A and B in the front surface of recording sheet 50 are indicated by a1 to a7 and b1 and b7. When recording sheet 50 is folded so that print regions A and B are laid on each other, lines a1 to a7 are laid on lines b7 to b1, respectively. Herein, among the pairs of lines laid on each other, the pairs of lines on both of which there are no color circles indicated by Ye, Ma, or Cy are the pair of lines a2 and b6 and the pair of lines a4 and b4. The lines satisfying the above condition in print region A are a2 and a4. Accordingly, in order to prevent the toner images from overlapping the white toner images when recording sheet 50 is folded at fold line 101, real print data is created so that white toner images are formed in the rectangular shaded portions on lines a2 and a4 of print region A.

For example, in the case where a white toner image is formed on line a6, a part of the circular toner images on line b2 can be transferred to line a6 (hereinafter, referred to as setoff in some cases) when print regions A and B once adhering to each other are separated. Embodiment 2 is configured to prevent a set-off caused in such a manner.

The same applies to print regions C' and B' in the back surface of recording sheet 50 as illustrated in FIG. 15. To be specific, when recording sheet 50 is folded so that print regions C' and B' are laid on each other, among the pairs of lines laid on each other, the pairs of lines on both of which there are no color circles indicated by Ye, Ma, or Cy are the pair of lines C'4 and b'4 and the pair of lines C'2 and b'6. Accordingly, in order to prevent the toner images from overlapping the white toner image when recording sheet 50 is folded at fold line 102, real print data is created so that white toner images are formed in the rectangular shaded portions on lines c'4 and c'2 of print region C'.

The double-sided trifold printing performed by the image formation apparatus of Embodiment 2 is carried out by the processing steps described in the flowcharts of FIGS. 10 and 11 of Embodiment 1 described above, other than the formation of the white toner images described above. The description thereof is therefore omitted. When delivered to the outside, recording sheet 50 is double-side printed and is folded in three adhering to one another. Herein, print regions A and B (print regions C' and B') can be separated from each other by human power (if necessary) and, once separated, cannot adhere to each other again even if laid on each other (unless recording sheet 50 passes through the fixation section again).

In Embodiment 2, in one of the print regions (A, C') facing each other, the white toner images are formed on one of each pair of lines which are laid on each other and neither of which includes color circles indicated by Ye, Ma, or Cy. However, white toner images may be formed in both print regions facing each other (print regions A and B, print regions C' and B'). In Embodiment 2, the white toner images are formed in the rectangular shaded portions. However, the profile of white toner images is not limited to a rectangle as long as the white toner images be formed in the area where color images corresponding to the portions indicated by the circles of yellow, magenta, and cyan are not formed.

As described above, according to the image formation apparatus of Embodiment 2, the printing process to print images on recording sheet 50 and the folding process to fold recording sheet 50 for adhesion of the folded portion can be performed by a series of steps. Moreover, toner images do not overlap white toner images even when recording sheet 50 is folded. Accordingly, it is possible to prevent the toner images from partially setting off when the print regions once adhering to each other are separated, thus providing better images.

Embodiment 3

An image formation apparatus of Embodiment 3 differs from the image formation apparatuses of Embodiments 1 and 2 mainly in using a clear toner instead of a white toner.

The clear toner used in Embodiment 3 can be prepared by, for example, the manufacturing method of cyan (C) described in Embodiment 1 with pigment phthalocyanine blue removed, or the manufacturing method of white (W) toner with pigment titanium oxide removed.

To be specific, the image formation apparatus of Embodiment 3 is configured so that toner cartridge 1 (FIG. 2) of image formation unit 34 illustrated in FIG. 1 is charged with a clear toner instead of a white toner. The image formation apparatus of Embodiment 3 is configured to perform double-sided trifold printing based on real print data illustrated in FIGS. 14 to 16 described in Embodiment 2, for example, by the processing steps described by the flowcharts illustrated in FIG. 10 or 11 in Embodiment 1. Herein, the print regions A and B adhering to each other and print regions C' and B' adhering to each other are just glued with clear toner. Accordingly, print regions A and B (print regions C' and B') can be separated from each other by human power (if necessary) but once separated, cannot adhere to each other again even if laid on each other (unless recording sheet 50 passes through the fixation section again).

According to the image formation apparatus of Embodiment 3, the printing process to print images on recording sheet 50 and the folding process to fold the recording sheet 50 for adhesion of the folded portion can be performed by the series of steps. Moreover, the clear toner is inconspicuous, allowing use of paper of colors other than white as recording sheets.

Embodiment 4

An image formation apparatus of Embodiment 4 differs from the image formation apparatus of Embodiment 3 mainly in the method of creating the real print data illustrated in FIGS. 14 to 16 which are described in Embodiment 2, for example.

The image formation apparatus of Embodiment 4 uses transparent clear toner images as an adhesion means, for example. In this case, even if the clear toner images are formed on patterns printed by toner images of yellow (Y), magenta (M), and cyan (C), for example, the patterns printed in yellow, magenta, and cyan laid under the clear toner images are visible because the clear toner is colorless.

Accordingly, in Embodiment 4, in the case of performing double-sided trifold printing by the processing steps described by the flowcharts illustrated in FIGS. 10 and 11 of Embodiment 1, clear toner images are formed not only on lines a2, a4, and a6 in print region A, where the circles are not formed, but over the entire printable range (hereinafter, referred to as an entire area in some cases) of print region A. Moreover, in the real print data of FIG. 7 described in Embodiment 1, clear toner images are formed not only on lines c'6, c'4, and c'2 in print region C', where the circles are not formed, but over the entire area of print region C'.

However, set-off is more likely to occur in the aforementioned case. Accordingly, it may be configured to apply process black to the entire surface which is laid on and adheres to the surface to which the clear toner is applied. For example, toner images are not formed in print region B illustrated in FIG. 6 and print region B' illustrated in FIG. 7, and process black is applied to the entire surface of each region. This reduces the amount of information that can be transmitted to users, but it is considered to be difficult for users to find set-off on the black surface. Moreover, print regions A and B adhering to each other and print regions C' and B' adhering to each other are just glued with clear toner. Accordingly, print regions A and B (print regions C' and B') can be separated from each other by human power (if necessary) and, once separated, cannot adhere to each other again even if laid on each other (unless recording sheet 50 passes through the fixation section again).

In Embodiment 4 described above, the clear toner images are formed in print regions A and C'. However, clear toner images may be formed in print regions A and/or B and print regions C' and/or B'.

The embodiments described above show examples of double-sided trifold printing and single-side bifold printing. However, the invention is not limited thereto and can be applied to formation of prints folded into more than three.

In the embodiments described above, white toner or clear toner is used as the adhesion means by way of example for the purpose of making the adhesion means inconspicuous. The invention is not limited thereto and can employ adhesive toner of conspicuous color when needed.

In Embodiments 1 to 3 described above, image formation units 31 to 33 corresponding to yellow (Y), magenta (M), and cyan (C) that form toner images and image formation unit 34 that forms white (W) toner images as the adhesion means are sequentially arranged from the upstream side in the transport direction of recording sheets 50. The invention is not limited thereto, and image formation unit 34 and image formation units 31 to 33 may be arranged in reverse order.

In Embodiments 1 to 4 described above, print densities of white toner and clear toner images are full exposure densities. However, the invention is not limited thereto and does not depend on the densities as long as white toner and clear toner images can be ensured to serve as adhesives.

The types and amounts of the raw materials (the binder resin, charge control agent, and colorant, for example) of the base toner, the type, amount, and manufacturing method of micropowder (silica and titanium oxide, for example) mixed with the base toner, materials of the development and sponge rollers, and the like described in the aforementioned embodiments are shown just by way of example, and the invention is not limited thereto.

Embodiments 1 to 4 are described by using color printing as an example. The image formation apparatus of the invention may be dedicated to monochrome printing. In this case, the image formation apparatus includes only a black image formation unit with the image formation units for yellow, magenta, and cyan removed. Alternatively, some of the image formation units for yellow, magenta, and cyan may be replaced with black image formation units.

Furthermore, in Embodiment 1 to 4 described above, images are loaded in the image formation apparatus. However, the invention is not limited thereto and is applicable to various systems, including a system in which a personal computer as an upper-level device loads an image in advance to create real print data and transmits the created real print data to the image formation apparatus.

The description of the claims and embodiments includes the terms "upper", "lower", "front", "back", "horizontal", and "vertical". These words are used for convenience and do not limit absolute positional relations in the orientation of the image formation apparatus.

The aforementioned embodiments are described by using a color electrophotographic printer as the image formation apparatus by way of example. The invention is not limited to printers and is applicable to facsimiles, copiers, and the like using electrophotography. Moreover, the aforementioned embodiments do not include an image formation unit for black toner. However, the image formation apparatus according to the invention may further include an image formation unit for black, that is, it may be a normal printer capable of printing in black (K), yellow (Y), magenta (M), and cyan (C). The thus-configured image formation apparatus further includes an image formation unit for adhesion.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising a first image formation section configured to form a first developer image for an image based on image data;

a second image formation section configured to form a second developer image for adhesion with a colorless developer;

a transfer section configured to transfer the first developer image and the second developer image onto a print medium;

a folding section configured to fold the print medium to which the second developer image is transferred such that the colorless second developer image is located between two faces facing each other when the print medium is folded; and a fixation section configured to fix the first and second developer images on the print medium which is folded such that the two surfaces of the folded print medium facing each other adhere to each other with the second developer image, wherein the colorless second developer image is transferred to the entire image formable region in at least one of two faces facing each other when the print medium is to be folded.

2. An image formation apparatus, comprising a first image formation section configured to form a first developer image for an image based on image data;

a second image formation section configured to form a second developer image for adhesion with a colorless developer;

a transfer section configured to transfer the first developer image and the second developer image onto a print medium;

a folding section configured to fold the print medium to which the second developer image is transferred such that the colorless second developer image is located between two faces facing each other when the print medium is folded; and a fixation section configured to fix the first and second developer images on the print medium which is folded such that the two surfaces of the folded print medium facing each other adhere to each other with the second developer image, wherein the colorless second developer image is transferred to entire image formable regions in both two surfaces facing each other when the print medium is folded.

3. An image formation method, comprising:

a first step of transferring a first developer image for an image onto an upper side of a print medium transported along a predetermined transport path, the first developer image being formed based on image data corresponding to the upper side;

a second step of transferring a second developer image for adhesion onto a region in the upper side where the first developer image is not transferred;

a third step of folding the print medium already subjected to the second step;

a fourth step of performing fixation of the print medium already subjected to the third step;

a fifth step of reversing the upper side and a lower side of the print medium already subjected to the fourth step and guiding the print medium to the predetermined transport path, wherein the first to fifth steps are performed one or more times.

4. An image formation method, comprising:

a first step of transferring a first developer image for an image onto an upper side of a print medium transported along a predetermined transport path, the first developer image being formed based on image data corresponding to the upper side;

a second step of performing a fixation of the print medium already subjected to the first step;

a third step of reversing the upper side and a lower side of the print medium already subjected to the second step and guiding the print medium to the predetermined transport path;

a fourth step of transferring the first developer image for the image onto the upper side of the print medium already subjected to the third step, the first developer image being formed based on image data corresponding to the upper side;

a fifth step of performing a fixation of the print medium already subjected to the fourth step and then guiding the print medium to the predetermined transport path;

a sixth step of transferring a second developer image for adhesion onto a region where the first developer image is not transferred in the upper side of the print medium transported in the predetermined transport path;

a seventh step of folding the print medium already subjected to the sixth step;

an eighth step of performing a fixation of the print medium already subjected to the seventh step;

a ninth step of reversing the upper side and the lower side of the print medium already subjected to the eighth step and then guiding the print medium to the predetermined transport path, wherein the sixth to ninth steps are performed one or more times.

* * * * *